US011630410B2

(12) United States Patent
Endo

(10) Patent No.: US 11,630,410 B2
(45) **Date of Patent: *Apr. 18, 2023**

(54) SHEET PROCESSING APPARATUS AND IMAGE FORMING SYSTEM

(71) Applicant: CANON KABUSHIKI KAISHA, Tokyo (JP)

(72) Inventor: Takahiro Endo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/361,487

(22) Filed: Jun. 29, 2021

(65) Prior Publication Data

US 2021/0325809 A1 Oct. 21, 2021

Related U.S. Application Data

(63) Continuation of application No. 16/908,932, filed on Jun. 23, 2020, now Pat. No. 11,086,261.

(30) Foreign Application Priority Data

Jul. 12, 2019 (JP) ..... JP2019-130601

(51) Int. Cl.
*B65H 43/00* (2006.01)
*G03G 15/00* (2006.01)
(Continued)

(52) U.S. Cl.
CPC ..... *G03G 15/6582* (2013.01); *B65H 29/125* (2013.01); *B65H 35/0086* (2013.01); *B65H 43/00* (2013.01)

(58) Field of Classification Search
CPC ..... G03G 15/6582; G03G 2215/00818; B65H 29/125; B65H 35/0086; B65H 43/00;
(Continued)

(56) References Cited

U.S. PATENT DOCUMENTS 7,073,706 B2 7/2006 Yaginuma et al.
8,794,116 B2 8/2014 Tamura et al.
(Continued)

FOREIGN PATENT DOCUMENTS

CN 1923476 A 3/2007
CN 103287906 A 9/2013
(Continued)

OTHER PUBLICATIONS

Office Action dated Jul. 29, 2022, in Chinese Patent Application No. 202010652536.7.

*Primary Examiner* — Patrick H Mackey
(74) *Attorney, Agent, or Firm* — Venable LLP

(57) ABSTRACT

A sheet processing apparatus includes a puncher, a first sensor positioned upstream of the puncher in the conveyance direction, a second sensor positioned upstream of the first detection position in the conveyance direction, a drive source configured to drive the puncher, a controller configured to control the drive source. The controller executes a control mode including a first process of controlling a rotation speed of the puncher on a basis of a detection result of the second sensor and a second process of controlling the rotation speed of the puncher on a basis of a detection result of the first sensor. In the control mode, the controller does not stop rotation of the puncher in a period between the punching process on the preceding sheet and a punching process on the succeeding sheet.

20 Claims, 20 Drawing Sheets

(51) Int. Cl.
*B65H 29/12* (2006.01)
*B65H 35/00* (2006.01)

(58) Field of Classification Search
CPC ..... B65H 2301/4452; B26D 2007/322; B65G 2801/27
See application file for complete search history.

(56) References Cited

U.S. PATENT DOCUMENTS

| | | | | |
|---|---|---|---|---|
| 9,039,002 | B2 * | 5/2015 | Fukatsu | B26D 5/32 83/370 |
| 9,061,433 | B2 * | 6/2015 | Nakamura | G03G 15/6582 |
| 9,082,006 | B2 | 7/2015 | Kuriyama | |
| 9,144,915 | B2 | 9/2015 | Watanabe et al. | |
| 9,915,906 | B2 | 3/2018 | Egawa et al. | |
| 10,071,494 | B2 * | 9/2018 | Pantonial | B26D 5/086 |
| 10,562,732 | B2 | 2/2020 | Egawa | |
| 10,584,011 | B2 | 3/2020 | Matsuki | |
| 11,086,261 | B2 * | 8/2021 | Endo | B65H 43/00 |
| 2001/0049990 | A1 * | 12/2001 | Takaishi | B26D 5/34 83/628 |
| 2005/0212194 | A1 | 9/2005 | Moriyama et al. | |
| 2015/0360461 | A1 | 12/2015 | Sakata | |
| 2019/0018357 | A1 | 1/2019 | Kuribayashi | |

FOREIGN PATENT DOCUMENTS

| | | | |
|---|---|---|---|
| CN | 107915086 | A | 4/2018 |
| CN | 107934638 | A | 4/2018 |
| DE | 29702659 | U1 | 12/1997 |
| JP | H07-098522 | A | 4/1995 |
| JP | H10-194557 | A | 7/1998 |
| JP | H10-279170 | A | 10/1998 |
| JP | 2012-125893 | A | 7/2012 |
| JP | 2017-218313 | A | 12/2017 |

* cited by examiner

FIG.9

| INTER-PUNCHING DISTANCE[mm] | TARGET SPEED[pps] | SPEED CONTROL ENDING STEP NUMBER |
|---|---|---|
| : | : | : |
| : | : | : |
| 75.8 | : | : |
| 75.9 | : | : |
| 76.0 | 1582 | 160 |
| 76.1 | : | : |
| 76.2 | : | : |
| : | : | : |
| : | : | : |
| : | : | : |
| : | : | : |

FIG.14

| INTER-PUNCHING DISTANCE[mm] | TARGET SPEED[pps] | SPEED CONTROL ENDING STEP NUMBER |
|---|---|---|
| : | : | : |
| : | : | : |
| 89.6 | : | : |
| 89.7 | : | : |
| 89.8 | 1367 | 116 |
| 89.9 | : | : |
| 89.0 | : | : |
| : | : | : |
| : | : | : |
| : | : | : |
| : | : | : |

FIG.16

| CORRECTION DISTANCE[mm] | TARGET SPEED[pps] | SPEED CONTROL ENDING STEP NUMBER |
|---|---|---|
| : | : | : |
| : | : | : |
| 4.0 | : | : |
| 4.1 | : | : |
| 4.2 | 844 | 50 |
| 4.3 | : | : |
| 4.4 | : | : |
| : | : | : |
| : | : | : |
| : | : | : |
| : | : | : |

FIG.20A

| PUNCHING SPEED (SHEET CONVEYANCE SPEED) | |
|---|---|
| 420mm/sec | 246mm/sec |
| 117.9mm | 75.6mm |

FIG.20B

| | | PUNCHING SPEED (SHEET CONVEYANCE SPEED) = 420mm/sec | | PUNCHING SPEED (SHEET CONVEYANCE SPEED) = 246mm/sec | |
|---|---|---|---|---|---|
| ROUGH ADJUSTMENT STEP NUMBER | FINE ADJUSTMENT STEP NUMBER | ROUGH ADJUSTMENT CONTROL-APPLICABLE RANGE OF INTER-PUNCHING DISTANCE [mm] | FINE ADJUSTMENT CONTROL-APPLICABLE CORRECTION DISTANCE [mm] | ROUGH ADJUSTMENT CONTROL-APPLICABLE RANGE OF INTER-PUNCHING DISTANCE [mm] | FINE ADJUSTMENT CONTROL-APPLICABLE CORRECTION DISTANCE [mm] |
| 250 | 0 | 67.0～188.7 | 0 | 49.8～121.6 | 0 |
| 230 | 20 | 72.2～178.2 | -1.0～1.5 | 56.9～119.3 | -2.1～1.5 |
| 210 | 40 | 76.5～169.4 | -3.3～9.4 | 62.7～117.5 | -5.8～3.4 |
| 190 | 60 | 81.0～160.7 | -6.3～18.1 | 68.5～115.6 | -10.4～5.2 |
| 170 | 80 | 85.4～151.9 | -9.9～26.9 | 74.4～113.8 | -15.4～7.1 |
| 150 | 100 | 89.7～143.1 | -13.8～35.7 | 79.9～111.9 | -20.8～8.8 |

SHEET PROCESSING APPARATUS AND IMAGE FORMING SYSTEM

This is a continuation of U.S. patent application Ser. No. 16/908,932, filed Jun. 23, 2020.

BACKGROUND OF THE INVENTION

Field of the Invention

The present invention relates to a sheet processing apparatus that processes a sheet and an image forming system including the sheet processing apparatus.

Description of the Related Art

Conventionally, a finisher that is connected to an image forming apparatus such as a printer and performs a punching process on a sheet discharged from the image forming apparatus is proposed in, for example, Japanese Patent Laid-Open No. H10-279170. This finisher includes a sheet detection sensor that detects a sheet, a conveyance roller pair that conveys the sheet, and a punching unit that punches a hole in the sheet conveyed by the conveyance roller pair. The punching unit includes a puncher and a die that are rotatably supported by a casing, and a puncher driving motor that drives the puncher and the die in synchronization.

The puncher and the die are stopped standing-by at home positions, and driving thereof is started by the puncher driving motor on the basis of detection of a trailing end of the sheet by the sheet detection sensor. Then, the puncher and the die engage with each other at a predetermined position on a trailing end portion of the sheet conveyed by the conveyance roller pair, and punches a hole in the sheet.

In recent years, it has been requested to reduce the interval between a trailing end of a preceding sheet and a leading end of a succeeding sheet to improve the productivity of image forming apparatus. However, in the finisher disclosed in Japanese patent Laid-Open No. H10-279170, the puncher and the die are stopped at the home positions until the trailing end of the sheet to be punched is detected, and therefore a predetermined holding time for the vibration of the puncher driving motor to settle has to be secured. If driving of the puncher driving motor is started without securing the holding time, the punching precision is degraded.

Therefore, the predetermined holding time described above has to be provided between completion of the punching process on the preceding sheet and start of the punching process on the succeeding sheet, which hinders the improvement in the productivity.

SUMMARY OF THE INVENTION

According to one aspect of the present invention, a sheet processing apparatus includes a conveyance portion configured to convey a sheet in a conveyance direction, a puncher rotatably supported and configured to, while rotating, punch a hole at a predetermined position in a sheet being conveyed by the conveyance portion, a first sensor configured to change an output value thereof in accordance with presence/absence of a sheet at a first detection position positioned upstream of the puncher in the conveyance direction, a second sensor configured to change an output value thereof in accordance with presence/absence of a sheet at a second detection position positioned upstream of the first detection position in the conveyance direction, a drive source configured to drive the puncher, a controller configured to control the drive source, wherein, in a case where a leading end of a succeeding sheet is positioned between the first detection position and the second detection position in the conveyance direction when a punching process on a preceding sheet by the puncher is finished, the controller executes a control mode including a first process of controlling a rotation speed of the puncher on a basis of a detection result of the second sensor and a second process of controlling the rotation speed of the puncher on a basis of a detection result of the first sensor, and wherein, in the control mode, the controller does not stop rotation of the puncher in a period between the punching process on the preceding sheet and a punching process on the succeeding sheet.

Further features of the present invention will become apparent from the following description of exemplary embodiments with reference to the attached drawings.

BRIEF DESCRIPTION OF THE DRAWINGS

FIG. 9 is a control table illustrating a relationship between inter-punching distance, target speed, and speed control ending step number in the motor acceleration/deceleration control.

FIG. 14 is a control table illustrating a relationship between inter-punching distance, target speed, and speed control ending step number in the motor rough adjustment control.

FIG. 16 is a control table illustrating a relationship between inter-punching distance, target speed, and step number at the end of speed control in the motor fine adjustment control.

FIG. 20A is a table illustrating minimum inter-punching distances with which the puncher driving motor can be stopped temporarily.

FIG. 20B is a table illustrating ranges of inter-punching distance to which the motor rough adjustment control is applicable and of correction distance to which the motor fine adjustment control is applicable.

DESCRIPTION OF THE EMBODIMENTS

Exemplary embodiments of the present invention will be described below with reference to drawings.

First Exemplary Embodiment

Overall Configuration

Figure 1:
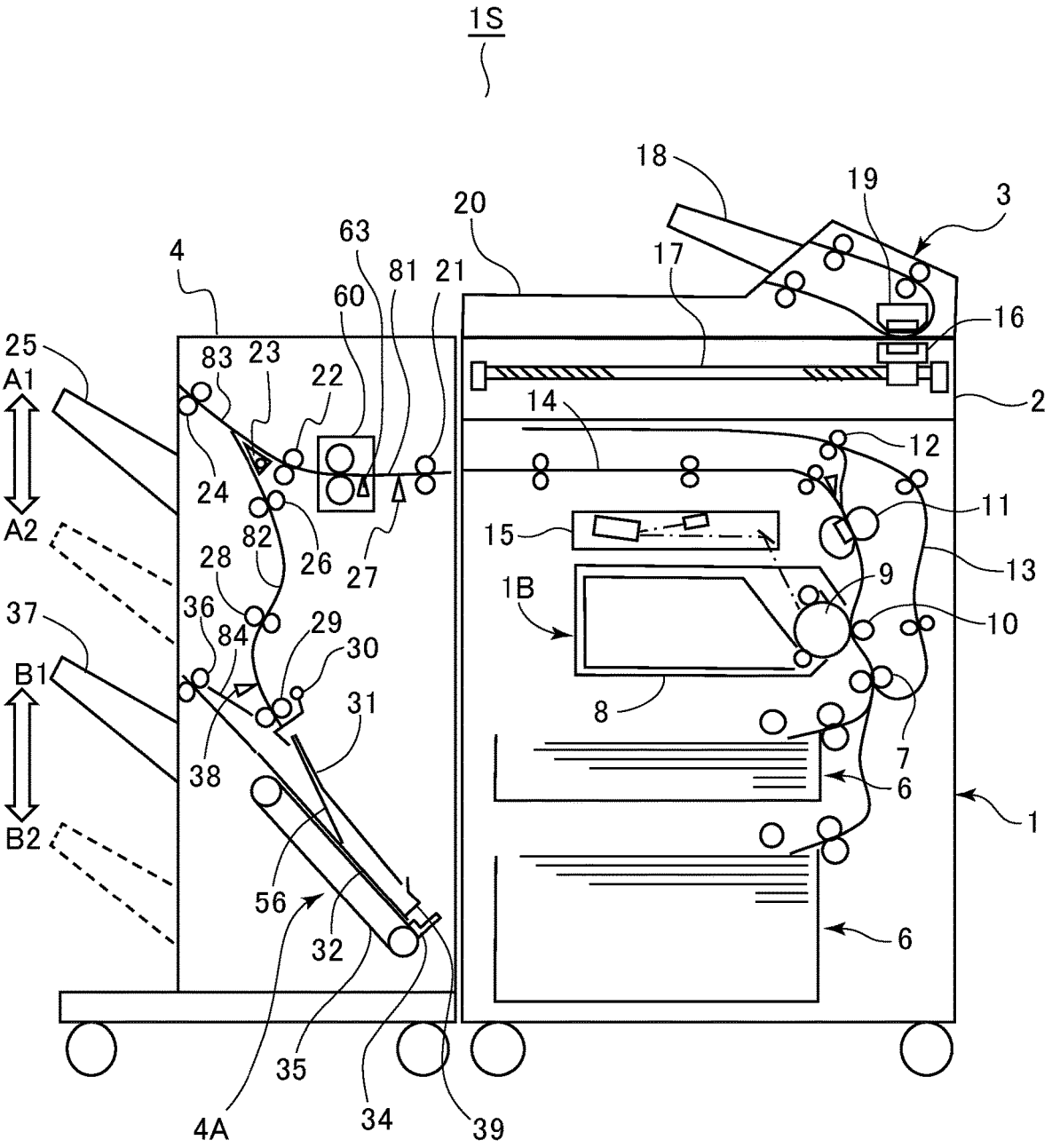
FIG. 1 is an overall schematic view of an image forming apparatus according to a first exemplary embodiment.

As illustrated in FIG. 1, an image forming system 1S according to a first exemplary embodiment includes an image forming apparatus 1, an image reading apparatus 2, a document feeding apparatus 3, and a sheet processing apparatus 4. The image forming system 1S forms an image on a sheet serving as a recording material, and outputs the sheet after processing the sheet by the sheet processing apparatus 4 if necessary. Hereinafter, simple description of operation of each apparatus will be given, and then the sheet processing apparatus 4 will be described in detail.

The document feeding apparatus 3 conveys a document placed on a document tray 18 to image reading portions 16 and 19. The image reading portions 16 and 19 are each an image sensor that reads image information from a document surface, and both surfaces of the document are read in one time of document conveyance. The document whose image information has been read is discharged onto a document discharge portion 20. In addition, the image reading apparatus 2 is capable of reciprocating the image reading portion 16 by a driving unit 17 and thus reading image information from a still document set on a platen glass. Examples of the still document include documents such as booklets for which the document feeding apparatus 3 cannot be used.

The image forming apparatus 1 is an electrophotographic apparatus including an image forming portion 1B of a direct transfer system. The image forming portion 1B includes a cartridge 8 including a photosensitive drum 9, and a laser scanner unit 15 provided above the cartridge 8. In the case of performing an image forming operation, the surface of the rotating photosensitive drum 9 is charged, and the laser scanner unit 15 exposes the photosensitive drum 9 on the basis of image information to draw an electrostatic latent image on the surface of the photosensitive drum 9. The electrostatic latent image born on the photosensitive drum 9 is developed into a toner image with charged toner particles, and the toner image is conveyed to a transfer portion where the photosensitive drum 9 and a transfer roller 10 face each other. A controller of the image forming apparatus 1 performs the image forming operation by the image forming portion 1B on the basis of image information read by the image reading portions 16 and 19 or image information received from an external computer via a network.

The image forming apparatus 1 includes a plurality of feeding apparatuses 6 each feeds sheets serving as recording materials one by one at predetermined intervals. The skew of a sheet fed from a feeding apparatus 6 is corrected by registration rollers 7, then the sheet is conveyed to the transfer portion, and in the transfer portion, the toner image born on the photosensitive drum 9 is transferred onto the sheet. A fixing unit 11 is disposed downstream of the transfer portion in a sheet conveyance direction. The fixing unit 11 includes a rotary member pair that nip and convey the sheet, and a heat generation member such as a halogen lamp for heating the toner image, and performs a fixing process of the image by heating and pressurizing the toner image on the sheet.

In the case of discharging the sheet having undergone image formation to the outside of the image forming apparatus 1, the sheet having passed through the fixing unit 11 is conveyed to the sheet processing apparatus 4 through a horizontal conveyance portion 14. In the case of a sheet on a first surface of which image formation has been finished in duplex printing, the sheet having passed through the fixing unit 11 is passed onto reverse conveyance rollers 12, switched back by the reverse conveyance rollers 12, and conveyed to the registration rollers 7 again through a reconveyance portion 13. Then, the sheet passes through the transfer portion and the fixing unit 11 again, thus an image is formed on the second surface thereof, and then the sheet is conveyed to the sheet processing apparatus 4 through the horizontal conveyance portion 14.

The image forming portion 1B described above is an example of an image forming portion that forms an image on a sheet, and an electrophotographic unit of an intermediate transfer system that transfers a toner image formed on a photosensitive member onto a sheet via an intermediate transfer member may be used therefor. In addition, a printing unit of an inkjet system or an offset printing system may be used as the image forming portion.

Sheet Processing Apparatus

The sheet processing apparatus 4 includes a punching device 60 configured to perform a punching process on a sheet, performs the punching process on sheets received from the image forming apparatus 1, and discharges the sheets as a sheet bundle. The sheet processing apparatus 4 is also capable of simply discharging a sheet received from the image forming apparatus 1 without performing the punching process on the sheet.

The sheet processing apparatus 4 includes an entry path 81, an in-body discharge path 82, a first discharge path 83, and a second discharge path 84 as conveyance paths for conveying a sheet, and an upper discharge tray 25 and a lower discharge tray 37 as discharge destinations onto which a sheet is to be discharged. The entry path 81 serving as a first conveyance path is a conveyance path in which a sheet is received from the image forming apparatus 1 and guided, and the in-body discharge path 82 serving as a second conveyance path is a conveyance path which extends below the entry path 81 and through which a sheet is guided toward an alignment portion 4A. The first discharge path 83 is a conveyance path through which a sheet is discharged onto the upper discharge tray 25, and the second discharge path 84 serving as a third conveyance path is a conveyance path which extends from an intermediate supporting portion 39 toward bundle discharge rollers 36 and through which a sheet is guided to the bundle discharge rollers 36.

A sheet discharged from the horizontal conveyance portion 14 of the image forming apparatus 1 is received by inlet rollers 21 serving as a conveyance portion disposed in the entry path 81, and is conveyed toward pre-reverse rollers 22 through the entry path 81. The punching device 60 is disposed between the inlet rollers 21 and the pre-reverse rollers 22 in the sheet conveyance direction, and the punching process is performed on the sheet conveyed through the entry path 81 by the punching device 60 that will be described later. In addition, an entrance sensor 27 changes an output value thereof on the basis of presence/absence of a sheet at a second detection position between the inlet rollers 21 and the pre-reverse rollers 22. Examples of the output value include a voltage value and an output signal. The entrance sensor 27 serving as a second sensor is positioned upstream of a pre-puncher sensor 63 that will be described later in the conveyance direction. The pre-reverse rollers 22 convey a sheet received from the inlet rollers 21 toward the first discharge path 83.

To be noted, the conveyance speed of the sheet may be increased after the inlet rollers 21 have received the sheet, by setting a higher sheet conveyance speed for the inlet rollers 21 than for the horizontal conveyance portion 14. In this case, it is preferable that a one-way clutch is disposed between a conveyance roller of the horizontal conveyance portion 14 and a motor that drives the conveyance roller such that the conveyance roller idles even if the sheet is pulled by the inlet rollers 21.

In the case where the discharge destination of the sheet is the upper discharge tray 25, reverse conveyance rollers 24 discharge the sheet received from the pre-reverse rollers 22 onto the upper discharge tray 25. In the case where the discharge destination of the sheet is the lower discharge tray 37, the reverse conveyance rollers 24 serving as a reverse portion performs switch-back conveyance in which the sheet received from the pre-reverse rollers 22 is reversed, and conveys the sheet to the in-body discharge path 82. A non-return flap 23 is disposed in a branching portion which is positioned upstream of the reverse conveyance rollers 24 in the sheet discharge direction of the reverse conveyance rollers 24 and in which the entry path 81 and the in-body discharge path 82 branch from the first discharge path 83. The non-return flap 23 has a function of suppressing the sheet switched back by the reverse conveyance rollers 24 moving into the entry path 81 again.

The in-body discharge rollers 26, intermediate conveyance rollers 28, and kick-out rollers 29 serving as rotary member pairs disposed in the in-body discharge path 82 convey the sheet received from the reverse conveyance rollers 24 toward the alignment portion 4A while sequentially passing the sheet onto one another. The pre-intermediate supporting sensor 38 detects the sheet at a position between the intermediate conveyance rollers 28 and the kick-out rollers 29. For example, optical sensors that detect presence/absence of the sheet at detection positions by using light of flag sensors using a flag pushed by the sheet are used for the entrance sensor 27, the pre-puncher sensor 63, and the pre-intermediate supporting sensor 38.

The alignment portion 4A includes a bundle pressing flag 30, an intermediate supporting portion 39 serving as a supporting portion, a bundle discharge guide 34, and a driving belt 35. The intermediate supporting portion 39 is constituted by an intermediate upper guide 31 and an intermediate lower guide 32, and a plurality of sheets are supported thereon as a sheet bundle. The sheet bundle is discharged toward the intermediate supporting portion 39 by the kick-out rollers 29 constituted by a roller pair, and is then pressed against the intermediate lower guide 32 by the bundle pressing flag 30.

Then, the sheet bundle discharged onto the intermediate supporting portion 39 is guided downward along the intermediate lower guide 32, and is aligned by a longitudinal alignment plate provided at a downstream end portion of the intermediate supporting portion 39 in the sheet conveyance direction. In addition, the sheet bundle aligned in the sheet conveyance direction is aligned in a width direction perpendicular to the sheet conveyance direction by an unillustrated lateral alignment plate. After such an alignment process is performed, the sheet bundle is pushed out by the bundle discharge guide 34 fixed to the driving belt 35, and passed onto bundle discharge rollers 36 through the second discharge path 84. The sheet bundle is discharged to the outside of the apparatus by the bundle discharge rollers 36 serving as a discharge portion, and is supported on the lower discharge tray 37.

The upper discharge tray 25 and the lower discharge tray 37 are each capable of moving up and down with respect to the casing of the sheet processing apparatus 4. The sheet processing apparatus 4 includes sheet surface detection sensors that respectively detect the positions of upper surface of sheets on the upper discharge tray 25 and the lower discharge tray 37, that is, the stacking heights of the sheets, and when either one of the sensors detects a sheet, the corresponding tray is lowered in an A2 direction or a B2 direction. In addition, when removal of the sheet on the upper discharge tray 25 or the lower discharge tray 37 is detected by the sheet surface detection sensor, the corresponding tray is lifted in an A1 direction or a B1 direction. Accordingly, the upper discharge tray 25 and the lower discharge tray 37 are controlled to ascend and descend so as to maintain a constant height of the upper surface of supported sheets.

Punching Device

Figure 2A:
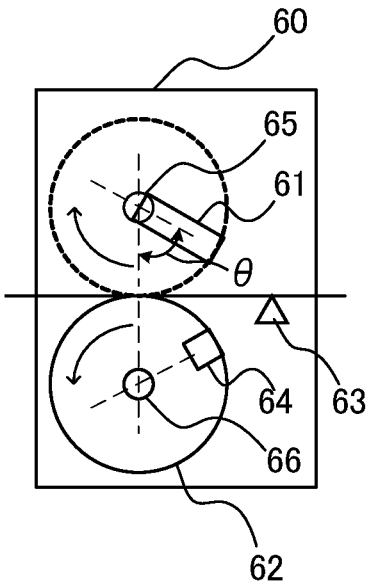
FIG. 2A is a schematic view of a puncher and a die at home positions.

Next, the punching device 60 will be described. The punching device 60 is a punching device of a rotary system that punches holes in sheets by a rotating puncher. As illustrated in FIG. 2A, the punching device 60 includes a puncher 61 rotatably supported around a puncher shaft 65, a die 62 that rotates about a die shaft 66, and the pre-puncher sensor 63. The die 62 has a die hole 64 capable of engaging with the puncher 61, and the puncher shaft 65 and the die shaft 66 are engaged with unillustrated gears driven by a puncher driving motor 102 illustrated in FIG. 3. The puncher driving motor 102 serving as a drive source drives the puncher 61 and the die 62, and thus the puncher 61 rotates in the clockwise direction and the die 62 rotates in the counterclockwise direction in FIG. 2A.

The pre-puncher sensor 63 serving as a first sensor detects the sheet at a first detection position positioned upstream of the puncher 61 and the die 62 in the conveyance direction. More specifically, the pre-puncher sensor 63 changes the output value thereof on the basis of presence/absence of the sheet in the first detection position, and therefore the output value changes when the leading end or the trailing end of the sheet passes the detection position. Examples of the output value include a voltage value and an output signal.

FIG. 2A is a schematic diagram illustrating the puncher 61 and the die 62 positioned at home positions. The puncher 61 and the die 62 are positioned at the home positions at the start and end of an image formation job of forming an image on a sheet, and are also stopped at the home positions when no job is input. The puncher 61 and the die 62 are disposed so as not to hinder conveyance of the sheet at the home positions. In addition, the home position of the puncher 61 is a position upstream of an engaging position by an angle θ in a rotation direction. The engaging position is a position where the puncher 61 and the die 62 engage with each other.

Figure 2B:
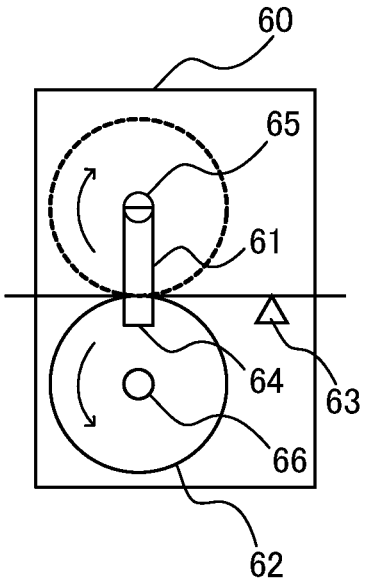
FIG. 2B is a schematic view of the puncher and the die at an engaging position.
Figure 2C:
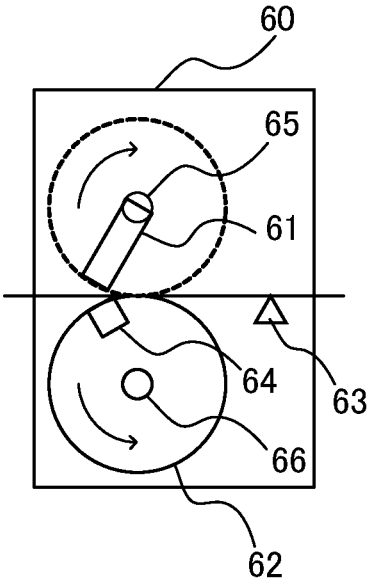
FIG. 2C is a schematic view of the puncher and the die at punching finishing positions.

FIG. 2B is a schematic diagram illustrating the puncher 61 and the die 62 positioned at the engaging position. When the puncher 61 and the die 62 are positioned at the engaging position, the puncher 61 engages with the die hole 64 of the die 62, and thus a hole is punched in the sheet. FIG. 2C is a schematic diagram illustrating the puncher 61 and the die 62 positioned at punching finishing positions.

As described above, the puncher 61 and the die 62 stand by at the home positions, and the puncher driving motor 102 starts driving the puncher 61 and the die 62 at a predetermined timing on the basis of detection of the leading end of the sheet by the pre-puncher sensor 63. At this time, the puncher driving motor 102 is controlled such that the peripheral speed of the puncher 61 and the die 62 matches the conveyance speed of the sheet to suppress wrinkling and breakage of the sheet during punching. The puncher 61 and the die 62 are separated from the punched sheet at the punching finishing positions.

Hardware Configuration

Figure 3:
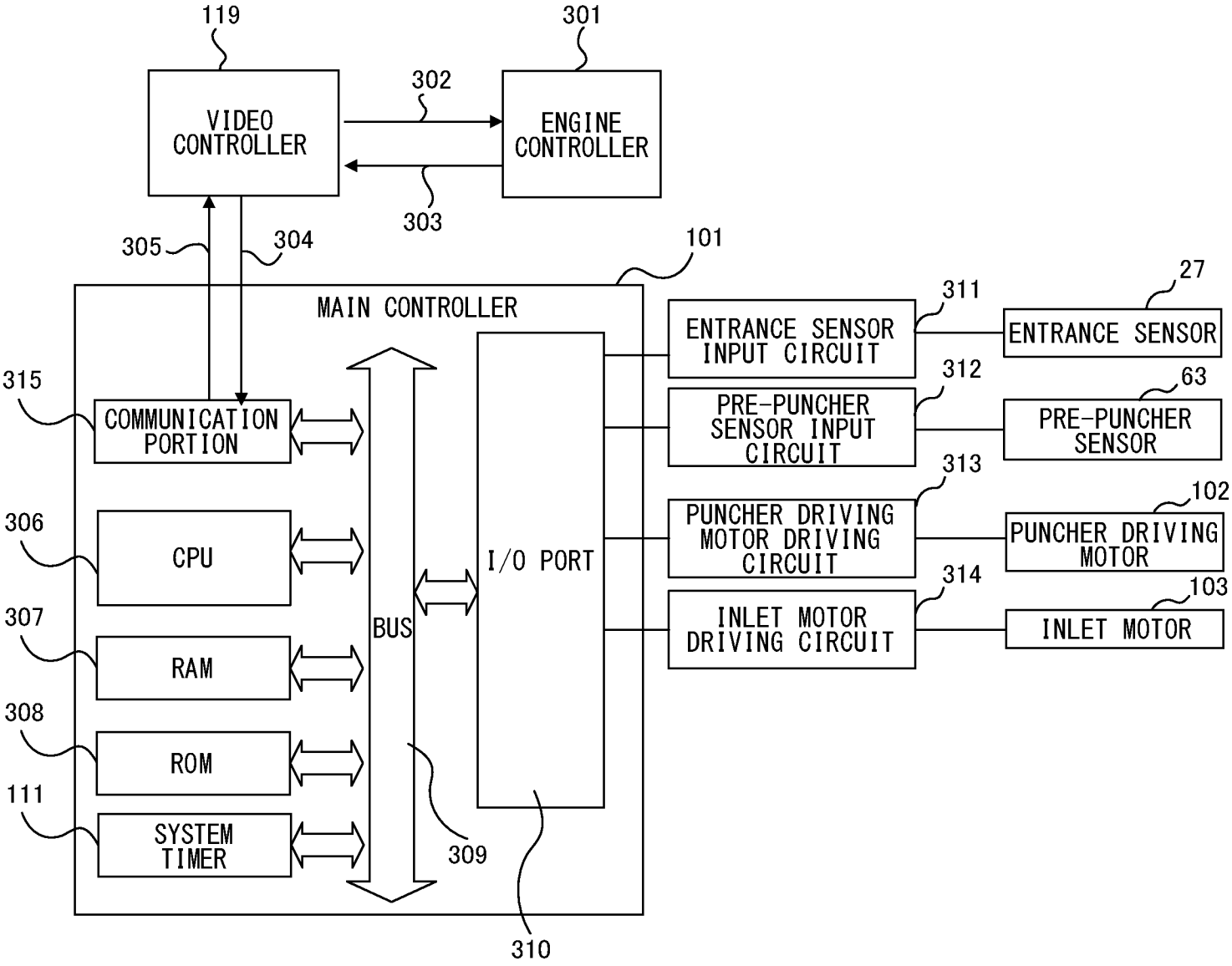
FIG. 3 is a block diagram illustrating a hardware configuration of an image forming system.

FIG. 3 is a block diagram illustrating a hardware configuration of the image forming system 1S. To be noted in FIG. 3, mainly elements of the sheet processing apparatus 4 related to the control of the present exemplary embodiment are illustrated, and illustration of other elements is omitted.

As illustrated in FIG. 3, the image forming system 15 includes a main controller 101, a video controller 119, and an engine controller 301, and the video controller 119 integrally controls the image forming apparatus 1 and the sheet processing apparatus 4. The engine controller 301 controls the image forming apparatus 1, and the main controller 101 controls the sheet processing apparatus 4.

The video controller 119 is connected to the engine controller 301 and the main controller 101 respectively via serial command transmission signal lines 302 and 304, and transmits commands to the engine controller 301 and the main controller 101 by serial communication. The engine controller 301 is connected to the video controller 119 via a serial status transmission signal line 303, and transmits status data to the video controller 119 by serial communication. The main controller 101 as a controller is connected to the video controller 119 via a serial status transmission signal line 305, and transmits status data to the video controller 119 by serial communication.

When performing an image forming operation, the video controller 119 performs control by transmitting serial commands to the engine controller 301 and the main controller 101 and receiving status data from the engine controller 301 and the main controller 101. As described above, in the case where a plurality of apparatuses operate in connection with each other, the video controller 119 integrally manages the control and state of each apparatus to maintain cohesion of operation between the apparatuses.

The main controller 101 includes a central processing unit: CPU 306, a random access memory: RAM 307, a read-only memory: ROM 308, a system timer 111, a communication portion 315, an input/output port: I/O port 310, and so forth. The CPU 306 is a central processing unit that controls various operations of the sheet processing apparatus 4. The RAM 307 is a volatile memory that temporarily stores control data required for operation of the sheet processing apparatus 4. The ROM 308 is a nonvolatile memory that stores programs and a control table required for operation of the sheet processing apparatus 4.

The system timer 111 generates timings required for various control, and the communication portion 315 performs communication with the video controller 119. The CPU 306, the RAM 307, the ROM 308, the system timer 111, and the communication portion 315 are connected to the I/O port 310 via a bus 309, and the I/O port 310 outputs and receives input of a control signal to and from various units of the sheet processing apparatus 4. More specifically, the I/O port 310 is connected to the entrance sensor 27 and the pre-puncher sensor 63 respectively via an entrance sensor input circuit 311 and a pre-puncher sensor input circuit 312. In addition, the I/O port 310 is connected to the puncher driving motor 102 and an inlet motor 103 respectively via a puncher driving motor driving circuit 313 and an inlet motor driving circuit 314. The inlet motor 103 drives the inlet rollers 21.

Functional Configuration

Figure 4:
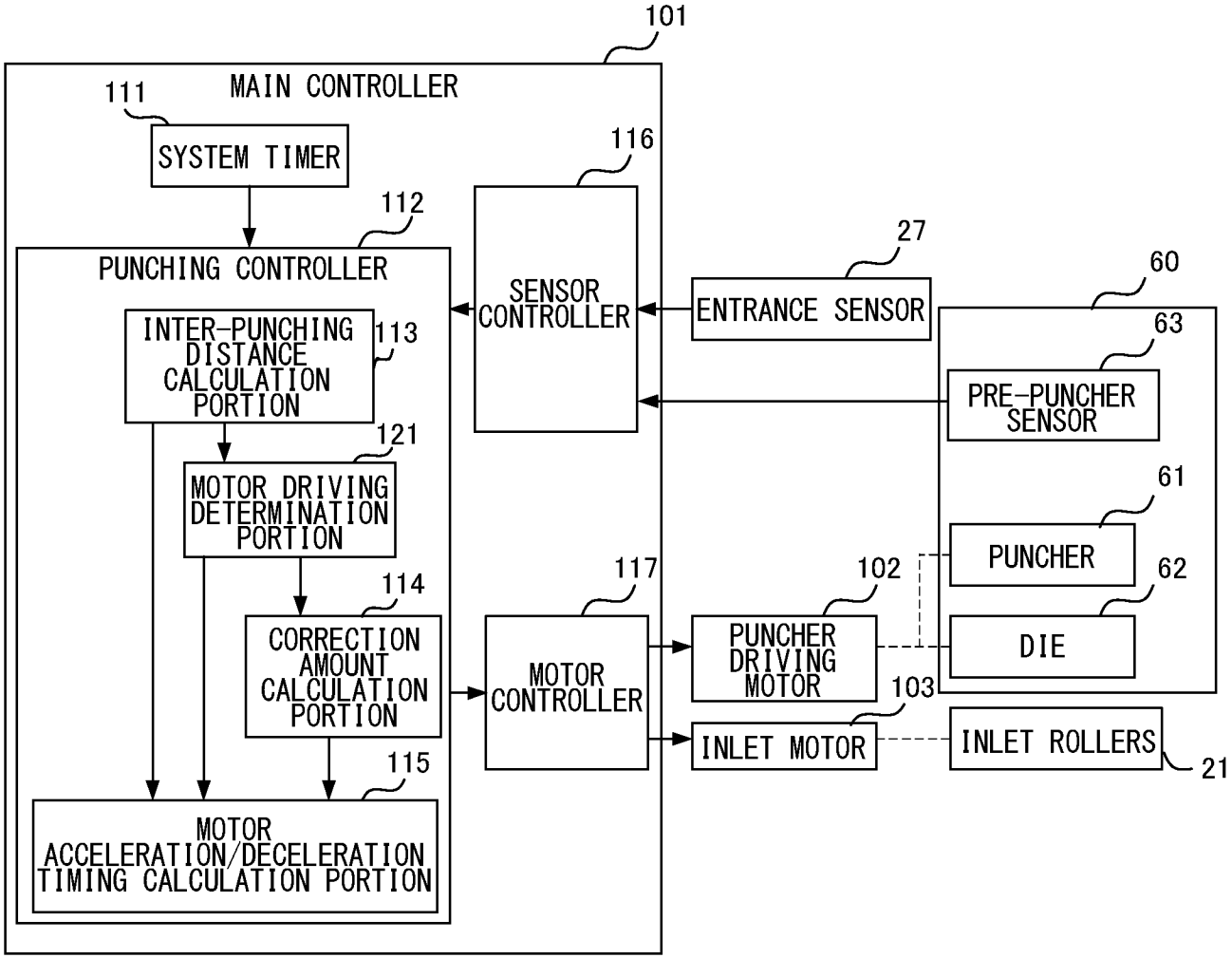
FIG. 4 is a block diagram illustrating a functional configuration of the image forming system.

FIG. 4 is a block diagram illustrating a functional configuration of the image forming system 1S. To be noted, in FIG. 4, mainly portions related to control of punching on a sheet according to the present exemplary embodiment are illustrated, and other portions are omitted.

As illustrated in FIG. 4, the main controller 101 includes a system timer 111, a punching controller 112, a sensor controller 116, and a motor controller 117, and performs control of conveyance of sheets and punching in the image forming system 1S. The sensor controller 116 receives input of signals from the entrance sensor 27 and the pre-puncher sensor 63 of the punching device 60, and outputs information about presence/absence of a sheet in each detection position to the punching controller 112. The punching controller 112 controls the motor controller 117 to drive the puncher driving motor 102 that drives the puncher 61 and the die 62 and the inlet motor 103 that drives the inlet rollers 21.

The punching controller 112 includes an inter-punching distance calculation portion 113, a motor driving determination portion 121, a correction amount calculation portion 114, and a motor acceleration/deceleration timing calculation portion 115. The punching controller 112 detects a sheet interval, which is a distance between a preceding sheet and a succeeding sheet, on the basis of time when the leading end and trailing end of the sheets pass the detection positions of the entrance sensor 27 and the pre-puncher sensor 63.

The inter-punching distance calculation portion 113 calculates an inter-punching distance, which is a distance between the last punching position in the preceding sheet and the first punching position in the succeeding sheet in the sheet conveyance direction. To be noted, in the case where a plurality of holes are punched in the same sheet, the interval between the plurality of holes is defined in standards. The interval between the plurality of holes will be hereinafter referred to as a standard hole interval. For example, in the case of punching two holes in the same sheet, the interval between these holes is 80 mm, and in the case of punching three holes in the same sheet as often seen in north America, the intervals between these holes are 108 mm. The inter-punching distance is calculated from the sheet interval, the standard hole interval, a sheet length, a distance from the leading end or trailing end of a sheet to the punching position, and the like. The sheet length is the length of a sheet in the sheet conveyance direction.

The motor driving determination portion 121 compares the inter-punching distance calculated by the inter-punching distance calculation portion 113 with a temporary stop determination threshold value that will be described later, and determines whether to temporarily stop the operation of the puncher driving motor 102 in the punching or continue the rotational driving. The correction amount calculation portion 114 detects the difference between an inter-punching distance calculated from information of the entrance sensor 27 and an inter-punching distance calculated from information of the pre-puncher sensor 63, and calculates a correction amount for compensating the difference.

The motor acceleration/deceleration timing calculation portion 115 calculates a target speed and an acceleration/deceleration timing of the puncher driving motor 102 in accordance with the inter-punching distance calculated by the inter-punching distance calculation portion 113, the determination result of the motor driving determination portion 121, and the correction amount described above. Then, the motor controller 117 controls the puncher driving motor 102 on the basis of the target speed and the acceleration/deceleration timing.

Temporary Stop Determination Threshold Value

Next, the temporary stop determination threshold value serving as a predetermined threshold value will be described. In the present exemplary embodiment, in the case of performing punching control of punching a plurality of sheets successively, the puncher driving motor 102 is controlled by one of three control systems of temporary stop control, motor acceleration/deceleration control, and motor rough/fine adjustment control. The temporary stop control is control of temporarily stopping the rotational position of the puncher 61 at the home position, and the motor acceleration/deceleration control and motor rough/fine adjustment control are control of changing the rotation speed of the puncher 61 without temporarily stopping the puncher 61.

In the case of performing the temporary stop control, since the puncher driving motor 102 is temporarily stopped, time required for the puncher 61 to rotate once include a slow-down time, a holding time, and a slow-up time. The slow-down time is a time required for decelerating the puncher driving motor 102 from an upper limit speed that will be described later to temporarily stop the puncher driving motor 102. The holding time is a time in which the puncher driving motor 102 is temporarily stopped. The slow-up time is a time required for accelerating the temporarily stopped puncher driving motor 102 to a punching speed that will be described later. In addition, since the rotation speed of the puncher driving motor 102 also has an upper limit, the time required for one rotation of the puncher 61 at least cannot be shorter than a predetermined time determined according to the operation specifications of the motor.

Figure 5:
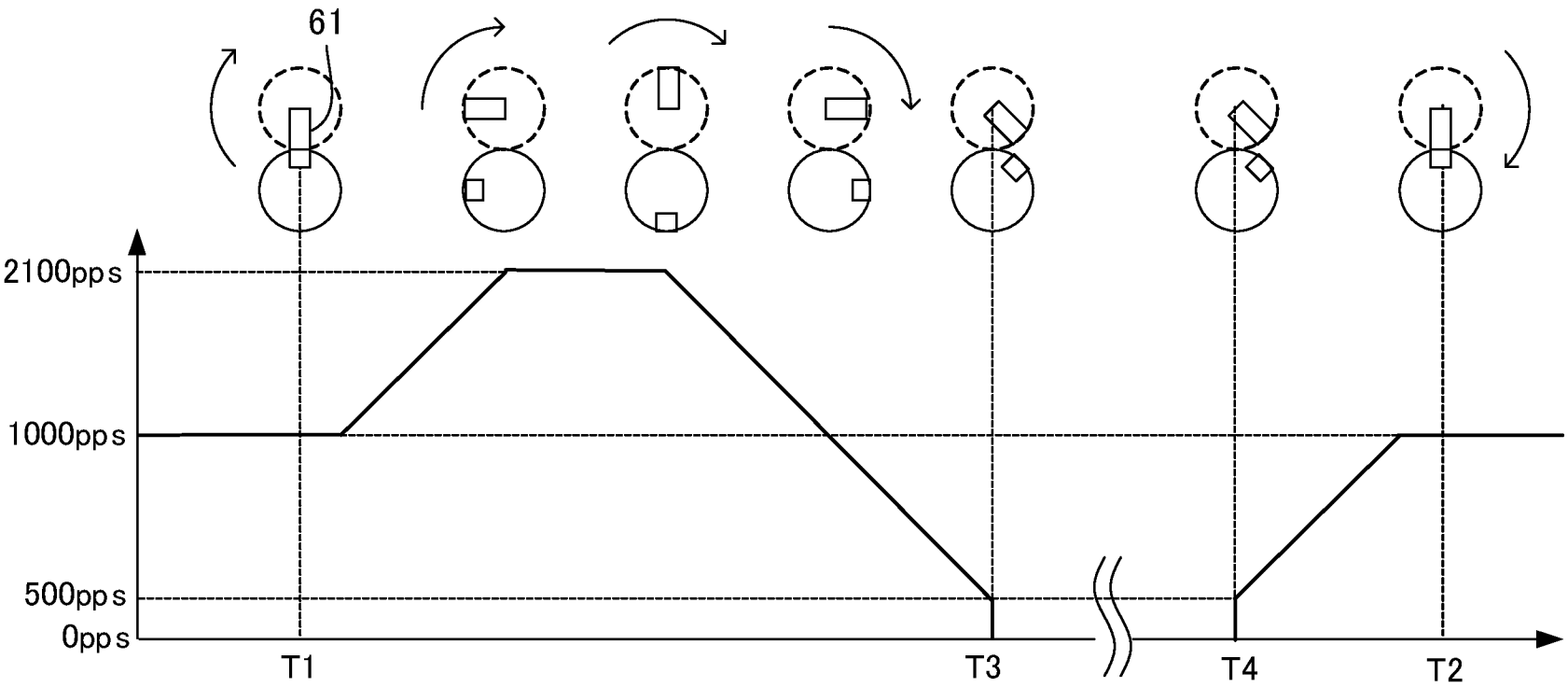
FIG. 5 is a timing chart illustrating rotational positions and rotation speed of a puncher driving motor in the case of performing temporary stop control.

FIG. 5 is a timing chart illustrating rotational positions and rotation speed of the puncher driving motor 102 when the temporary stop control is performed. In the present exemplary embodiment, the sheet conveyance speed is set to 420 mm/sec, the rotation speed of the puncher driving motor 102 synchronized with the sheet conveyance speed is set to 1000 pps, and the upper limit of the rotation speed of the puncher driving motor 102 is set to 2100 pps. In addition, in the present exemplary embodiment, the gradient of speed change of the puncher driving motor 102 is set to 1000 pps per 35 msec. In addition, the time required for one rotation of the puncher 61 corresponds to 250 steps in terms of the number of driving steps of the puncher driving motor 102 constituted by a stepping motor.

In FIG. 5 the puncher 61 punches a hole in the preceding sheet at a time point T1, and the rotation speed of the puncher driving motor 102 at this time is 1000 pps. This speed will be hereinafter referred to as a punching speed. Then, the puncher driving motor 102 is accelerated to 2100 pps, which is the upper limit speed, to rotate the puncher 61 to the home position in the shortest time. Then, the puncher driving motor 102 maintains the speed of 2100 pps, which is the upper limit speed, for a predetermined time, and is then decelerated in accordance with the slow-down time to temporarily stop. Then, the puncher 61 is temporarily stopped at the home position at a time point T3.

Then, after the elapse of a predetermined holding time, driving of the puncher driving motor 102 is resumed at a time point T4. To be noted, the holding time is set to a time longer than 100 msec, which is a time required for the vibration of the puncher driving motor 102 constituted by a stepping motor to settle. Then, the puncher driving motor 102 is accelerated to 1000 pps, which is the punching speed, and the puncher 61 punches a hole in the succeeding sheet at a time point T2.

In the case where the holding time from the time point T3 to the time point T4 is set to 100 msec, which is the shortest time, the time from the time point T1 to the time point T2 is 280.7 msec in the conditions described above. This 280.7 msec is the shortest time of the punching interval in the case of performing the temporary stop control, and this interval is 117.9 mm in terms of a travelled distance at a sheet conveyance speed of 420 mm/sec. Therefore, this 117.9 mm is the shortest inter-punching distance in the case of performing temporary stop control. To be noted, the punching interval described above is a time between the last punching on the preceding sheet and the first punching on the succeeding sheet.

In the case where the inter-punching distance is shorter than 117.9 mm, since the temporary stop control cannot be performed, one of the motor acceleration/deceleration control and the motor rough/fine adjustment control is performed. A threshold value used for determining whether to perform the temporary stop control or one of the motor acceleration/deceleration control and motor rough/fine adjustment control will be referred to as a temporary stop determination threshold value. Although the shortest inter-punching distance has been calculated as 117.9 mm in the description above, in the present exemplary embodiment, the temporary stop determination threshold value is set to a fixed value of 150 mm by adding a margin to the shortest inter-punching distance in consideration of conveyance variation and detection error. As described above, an appropriate temporary stop determination threshold value has to be determined for each case in accordance with the configuration of the apparatus and the motor driving specifications.

Punching Control

Figure 6:
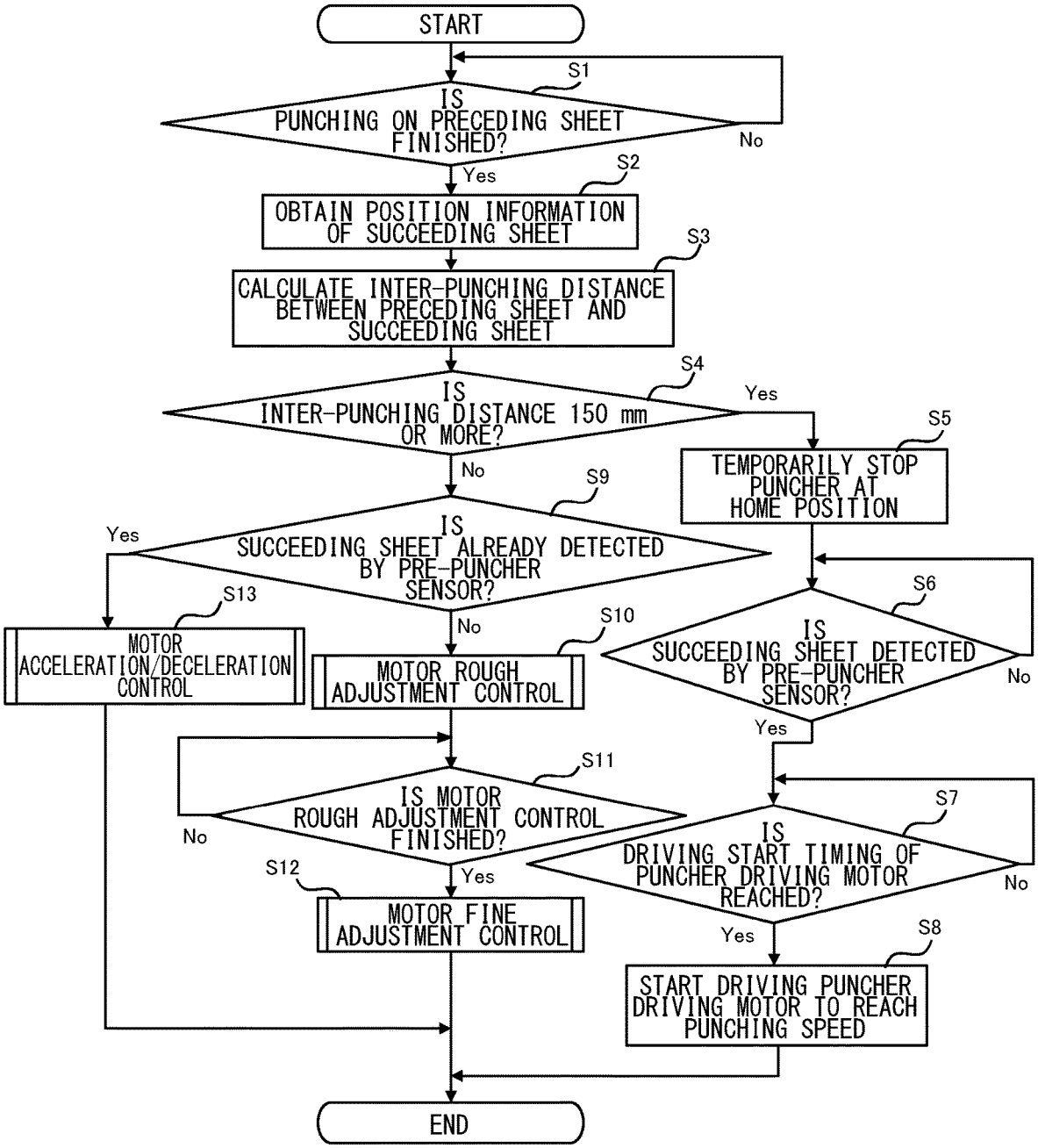
FIG. 6 is a flowchart illustrating punching control according to the first exemplary embodiment.

Next, the punching control according to the present exemplary embodiment will be described. As illustrated in FIG. 6, when the punching control is started, the main controller 101 determines in step S1 whether or not the punching on the preceding sheet has been finished. Whether or not the punching has been finished is determined on the basis of the puncher 61 being positioned at the engaging position by the puncher driving motor 102.

In the case where it is determined that the punching on the preceding sheet has been finished, that is, in the case where the result of step S1 is Yes, the main controller 101 obtains position information of the succeeding sheet in step S2. The position information of the succeeding sheet is obtained on the basis of a detection result of the entrance sensor 27. That is, in the case where the leading end of the preceding sheet is already detected by the entrance sensor 27 when the punching on the preceding sheet is finished, the position information of the preceding sheet can be obtained from the timing when the entrance sensor 27 is turned on. In the case where the leading end of the preceding sheet has not been detected by the entrance sensor 27 when the punching on the preceding sheet is finished, it is determined that there is a sufficient distance between the preceding sheet and the succeeding sheet.

Then, the main controller 101 calculates the inter-punching distance between the preceding sheet and the succeeding sheet in step S3 on the basis of the position information of the succeeding sheet obtained in step S2. Next, the main controller 101 determines in step S4 whether or not the inter-punching distance calculated in step S3 is equal to or larger than 150 mm, which is the temporary stop determination threshold value. To be noted, in the case where the preceding sheet is not detected by the entrance sensor 27 in step S2, it is determined that the inter-punching distance is 150 mm or more.

In the case where it is determined that the inter-punching distance is 150 mm or more, that is, in the case where the result of step S4 is Yes, the temporary stop control serving as a second control mode described above is executed. That is, the main controller 101 controls the puncher driving motor 102 in step S5 such that the puncher 61 is temporarily stopped at the home position. Then, the main controller 101 monitors the pre-puncher sensor 63 in step S6 until the leading end of the succeeding sheet is detected by the pre-puncher sensor 63.

In the case where the leading end of the succeeding sheet is detected by the pre-puncher sensor 63, that is, in the case where the result of step S6 is Yes, the main controller 101 determines in step S7 whether or not it is a driving start timing of the puncher driving motor 102. This driving start timing is calculated in consideration of the distance from the leading end of the succeeding sheet to the puncher 61 in the engaging position, the time for the puncher driving motor 102 to be accelerated from a stopped state to the punching speed of 1000 pps, and so forth. The main controller 101 counts time by using the system timer 111 until the driving start timing is reached.

In the case where the driving start timing is reached, that is, in the case where the result of step S7 is Yes, the main controller 101 starts driving the puncher driving motor 102 in step S8 to reach the punching speed. According to the process described above, a hole can be punched at a desired position in the succeeding sheet.

Figure 7A:
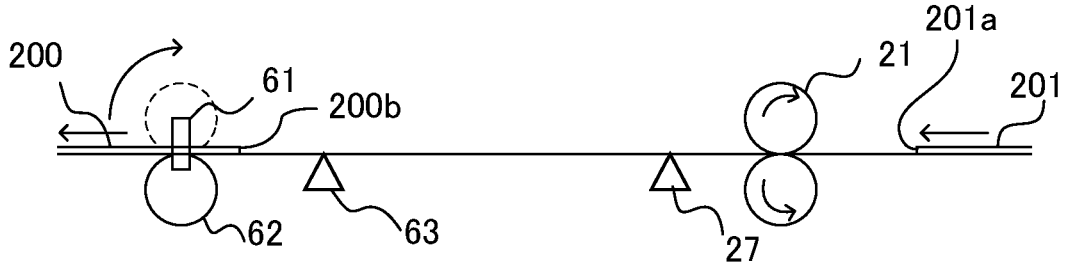
FIG. 7A is a diagram illustrating a sheet, the puncher, and the die in a punching process according to the temporary stop control.

FIGS. 7A to 7E are each a diagram illustrating a state of a sheet, the puncher 61, and the die 62 when performing the punching by the temporary stop control. FIG. 7A illustrates a state of the sheet, the puncher 61, and the die 62 at a timing when the punching on a preceding sheet 200 is finished. At this time, a succeeding sheet 201 has not reached the entrance sensor 27 yet.

In the present exemplary embodiment, the distance between the pre-puncher sensor 63 and the entrance sensor 27 is 150 mm or more. Therefore, in the case where a trailing end 200*b* of the preceding sheet 200 has already passed the pre-puncher sensor 63 and a leading end 201*a* of the succeeding sheet 201 has not been detected by the entrance sensor 27, it can be seen that the sheet interval between the preceding sheet and the succeeding sheet is 150 mm or more. Therefore, since the inter-punching distance is longer than the sheet interval, the inter-punching distance is 150 mm or more as a matter of course.

As described above, in the present exemplary embodiment, whether or not the inter-punching distance is equal to or more than the temporary stop determination threshold value, which is 150 mm in this example, can be determined on the basis of the detection results of the entrance sensor 27 and the pre-puncher sensor 63. Since the inter-punching distance is equal to or larger than the temporary stop determination threshold value, the main controller 101 controls the puncher driving motor 102 such that the puncher 61 is stopped at the home position in step S5 of FIG. 6.

Figure 7B:
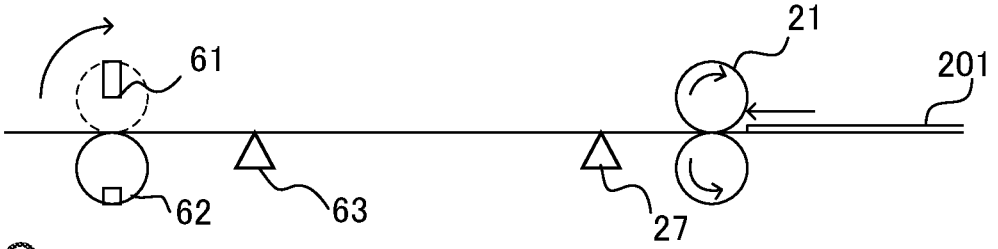
FIG. 7B is a diagram illustrating a sheet, the puncher, and the die in a punching process according to the temporary stop control.
Figure 7C:
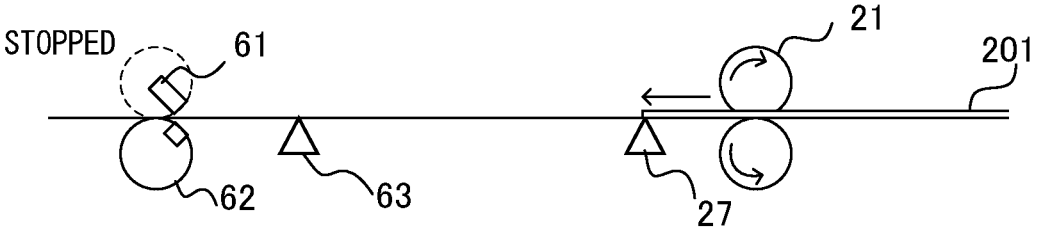
FIG. 7C is a diagram illustrating a sheet, the puncher, and the die in a punching process according to the temporary stop control.
Figure 7D:
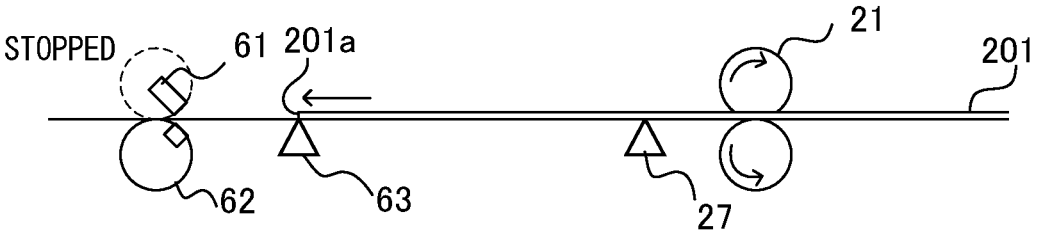
FIG. 7D is a diagram illustrating a sheet, the puncher, and the die in a punching process according to the temporary stop control.
Figure 7E:
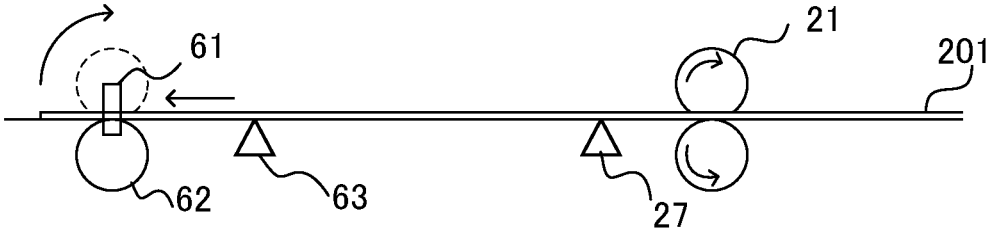
FIG. 7E is a diagram illustrating a sheet, the puncher, and the die in a punching process according to the temporary stop control.

FIG. 7B illustrates a state in which the puncher 61 and the die 62 are rotating toward the home positions, and FIG. 7C illustrates the puncher 61 and the die 62 stopped at the home positions. As illustrated in FIGS. 7C and 7D, the succeeding sheet 201 is conveyed by the inlet rollers 21 while the puncher 61 and the die 62 are stopped, and the leading end 201*a* of the succeeding sheet 201 is detected by the pre-puncher sensor 63 in step S6 of FIG. 6. Then, as illustrated in FIG. 7E, driving of the puncher driving motor 102 is started on the basis of the driving start timing being reached, and a hole is punched in the succeeding sheet 201 by the puncher 61 and the die 62 in steps S7 and S8. of FIG. 6. This is the operation of punching a hole in a sheet by temporary stop control.

In contrast, in the case where it is determined that the inter-punching distance is smaller than 150 mm in step S4 of FIG. 6, that is, in the case where the result of step S4 is No, the main controller 101 determines in step S9 whether or not the pre-puncher sensor 63 has detected the succeeding sheet. In the case where it is determined that the pre-puncher sensor 63 has detected the succeeding sheet, that is, in the case where the result of step S9 is Yes, the main controller 101 performs the motor acceleration/deceleration control of controlling acceleration/deceleration of the puncher driving motor 102 in step S13. In other words, in the case where the inter-punching distance is smaller than 150 mm, which is the temporary stop determination threshold value, and the succeeding sheet has reached the first detection position of the pre-puncher sensor 63, the motor acceleration/deceleration control serving as a third control mode is performed.

Motor Acceleration/Deceleration Control

Figure 8:
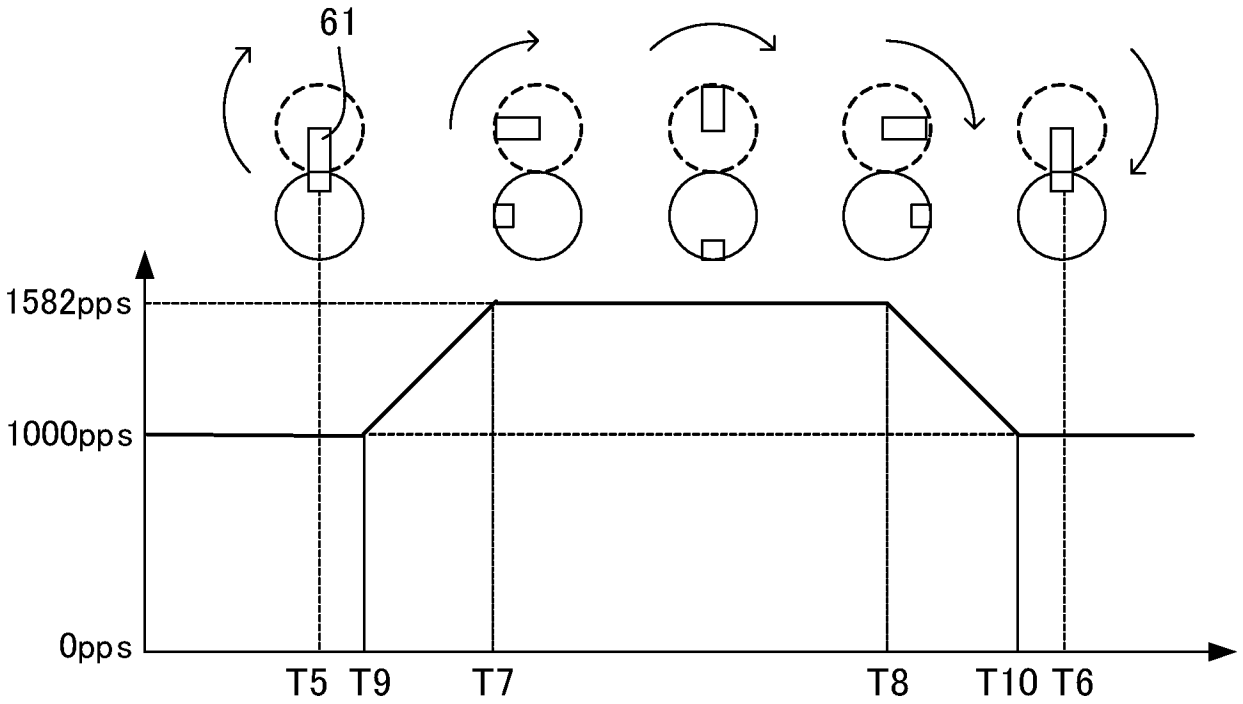
FIG. 8 is a timing chart illustrating rotational positions and rotation speed of the puncher driving motor in the case of performing motor acceleration/deceleration control.

FIG. 8 is a timing chart illustrating rotational positions and rotation speed of the puncher driving motor 102 in the case where the motor acceleration/deceleration control is performed. In FIG. 8, the puncher 61 punches a hole in the preceding sheet at a time point T5, and punches a hole in the succeeding sheet at a time point T6. The rotation speed of the puncher driving motor 102 at the time of punching, that is, the punching speed of the puncher driving motor 102 is 1000 pps. In the motor acceleration/deceleration control, the interval between the time points T5 and T6, that is, a punching interval is adjusted by accelerating or decelerating the puncher driving motor 102 without stopping the puncher driving motor 102 in the period between the time points T5 and T6.

In the present exemplary embodiment, when accelerating/decelerating the puncher driving motor 102, as illustrated in FIG. 8, the puncher driving motor 102 is controlled such that the timing chart has a trapezoidal shape. That is, the main controller 101 accelerates the puncher driving motor 102 to a predetermined target speed after punching a hole in the preceding sheet at the time point T5. Then, the main controller 101 drives the puncher driving motor 102 so as to maintain the target speed described above, and decelerates the puncher driving motor 102 such that the speed thereof reaches the punching speed, which is 1000 pps in this example, at the time point T6.

To be noted, in the present exemplary embodiment, the same parameters are used for the speed curve in any speed change. Therefore, the punching interval is necessarily determined by just determining the target speed and the speed change timing. Therefore, in the present exemplary embodiment, a control table including information of the punching interval, the target speed, and the speed change timing is stored in the ROM 308. The main controller 101 obtains the target speed and the speed change timing from the control table on the basis of the inter-punching distance calculated in step S3 of FIG. 6, and controls the puncher driving motor 102. As a result of this, punching on sheets can be performed at desired intervals.

In the present exemplary embodiment, the sheet conveyance speed is set to 420 mm/sec, the punching speed of the puncher driving motor 102 is set to 1000 pps, the upper limit speed of the puncher driving motor 102 is set to 2100 pps, and the lower limit speed of the puncher driving motor 102 is set to 500 pps. In addition, the gradient of speed change of the puncher driving motor 102 is set to 1000 pps per 35 msec. In addition, the time required for one rotation of the puncher 61 is 250 steps in terms of the number of driving steps of the puncher driving motor 102 constituted by a stepping motor. A control table generated in accordance with these conditions is shown in FIG. 9.

FIG. 9 is a control table in which the inter-punching distance [mm] in motor acceleration/deceleration control, and the target speed [pps] and a speed control ending step number of the puncher driving motor 102 corresponding to the inter-punching distance are described for every 0.1 mm of the inter-punching distance. The speed control ending step number is the number of steps in which the puncher driving motor 102, which is a stepping motor, maintains the target speed, and corresponds to a time from a time point T7 to a time point T8 in FIG. 8. To be noted, in FIG. 9, it is shown that the target speed is 1582 pps and the speed control ending step number is 160 steps when the inter-punching distance is 76.0 mm.

Further, FIG. 8 illustrates the speed and speed change timings of the puncher driving motor 102 in the case where the inter-punching distance is 76.0 mm. The puncher driving motor 102 is driving at 1000 pps at the time point T5 when the puncher 61 performs punching, and the puncher driving motor 102 is driven at 1000 pps in 20 steps from the time point T5 to a time point T9. The objective for this is to match the speed of the puncher 61 with the sheet conveyance speed in a period from the start of the punching to the end of the punching on the sheet.

Further, at the time point T9, the puncher driving motor 102 starts being accelerated to 1582 pps, which is the target speed obtained from the control table. It takes 25 steps to accelerate the puncher driving motor 102 from 1000 pps to 1582 pps, and the speed reaches 1582 pps at the time point T7. This "25 steps" is a step number that can be automatically determined because the gradient of the speed curve is determined in advance.

Then, the puncher driving motor 102 is maintained at 1582 pps, which is the target speed, for 160 steps. At the time point T8 after the elapse of the 160 steps, the puncher driving motor 102 starts being decelerated to 1000 pps, which is the punching speed, and reaches 1000 pps at a time point T10. It takes 25 steps for the puncher driving motor 102 to be decelerated from 1582 pps to 1000 pps. This "25 steps" is also a step number that can be automatically determined because the gradient of the speed curve is determined in advance. Then, the puncher driving motor 102 is driven at 1000 pps in 20 steps from the time point T10 to the time point T6, and a hole is punched in the succeeding sheet at the time point T6.

By controlling the acceleration and deceleration of the puncher driving motor 102 as described above, the time required for one rotation of the puncher 61 approximately matches a sheet conveyance time corresponding to the inter-punching distance of 76.0 mm. In the present exemplary embodiment, since the punching speed and the speed curve are determined in advance, just holding a table including the three of the inter-punching distance, the target speed, and the speed control ending step number is sufficient. To be noted, the data of the table is not limited to these three kinds of data, and the gradient of the speed curve may be also included in the table in the case where, for example, it is desired that the gradient of the speed curve is changed for some target speed.

To be noted, in FIG. 9, data is only shown for parts corresponding to the inter-punching distance of 76.0 mm, and description of data for other inter-punching distances is omitted. However, also in the case of inter-punching distance other than 76.0 mm, punching on a sheet can be performed at a desired inter-punching distance by obtaining the target speed and the speed control ending step number corresponding to the inter-punching distance.

In addition, the motor acceleration/deceleration control described above is performed in the case where the succeeding sheet is detected by the pre-puncher sensor 63 in step S9. In this case, the succeeding sheet has already come to a position close to the puncher 61, and variation of conveyance of the succeeding sheet beyond this point is approximately negligible. Therefore, punching can be performed on the sheet with high precision.

Figure 10:
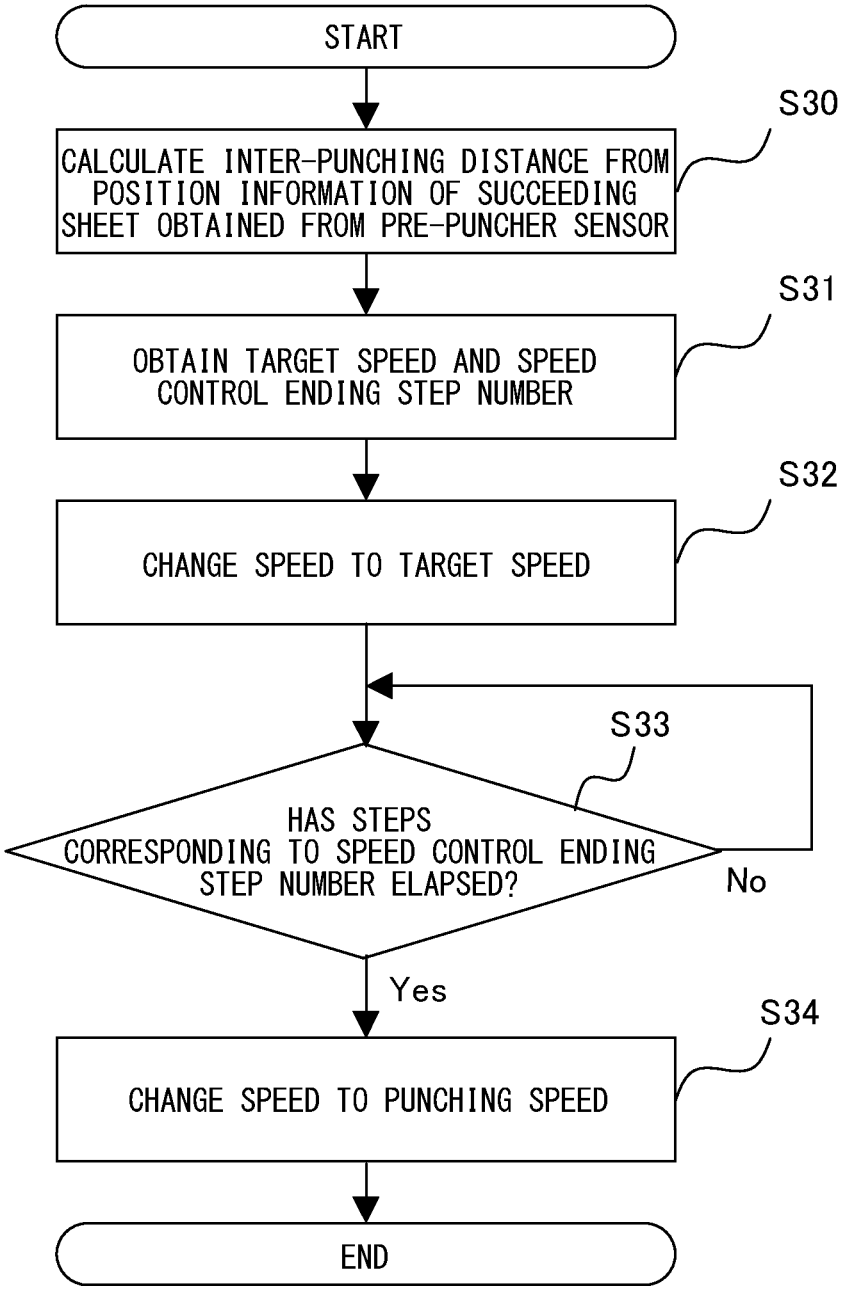
FIG. 10 is a flowchart illustrating each step of the motor acceleration/deceleration control.

FIG. 10 is a flowchart illustrating each step of the motor acceleration/deceleration control in detail. As illustrated in FIG. 10, when the motor acceleration/deceleration control is started, the main controller 101 calculates the inter-punching distance in step S30 from the position information of the succeeding sheet detected by the pre-puncher sensor 63. Then, in step S31, the main controller 101 obtains the target speed and speed control ending step number of the puncher driving motor 102 from the control table illustrated in FIG. 9 in accordance with the inter-punching distance calculated in step S30.

Next, the main controller 101 accelerates the puncher driving motor 102 to 1582 pps, which is the target speed, in step S32. Further, the main controller 101 stands by in step S33 after the puncher driving motor 102 has reached the target speed until the elapse of 160 steps, which is the speed control ending step number. In the case where steps corresponding to the speed control ending step number have elapsed, that is, in the case where the result of step S33 is Yes, the puncher driving motor 102 is decelerated to 1000 pps, which is the punching speed, in step S34. As described above, a hole can be punched in a desired position in the succeeding sheet without temporarily stopping the puncher driving motor 102.

Figure 11A:
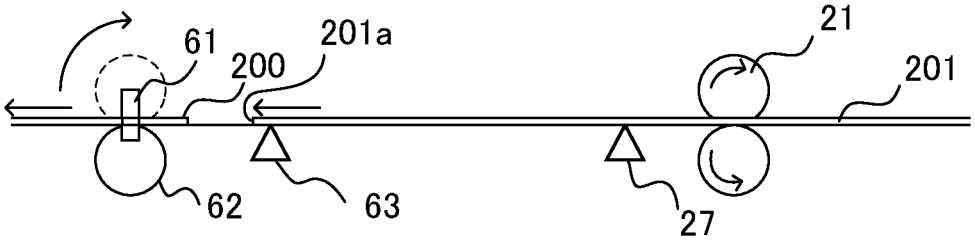
FIG. 11A is a diagram illustrating the sheet, the puncher, and the die in a punching process according to the motor acceleration/deceleration control.

FIGS. 11A to 11E are each a diagram illustrating a state of the sheet, the puncher 61, and the die 62 when performing punching by the motor acceleration/deceleration control. FIG. 11A is a diagram illustrating a state of the sheet, the puncher 61, and the die 62 at a timing when the punching on the preceding sheet 200 is finished. At this time, the leading end 201*a* of the succeeding sheet 201 has been already detected by the pre-puncher sensor 63.

Figure 11B:
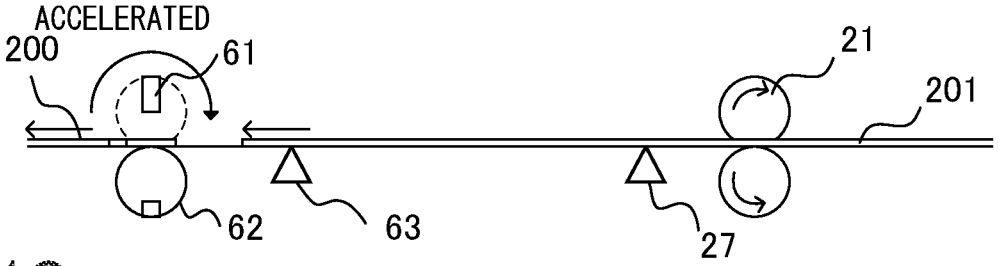
FIG. 11B is a diagram illustrating the sheet, the puncher, and the die in a punching process according to the motor acceleration/deceleration control.
Figure 11C:
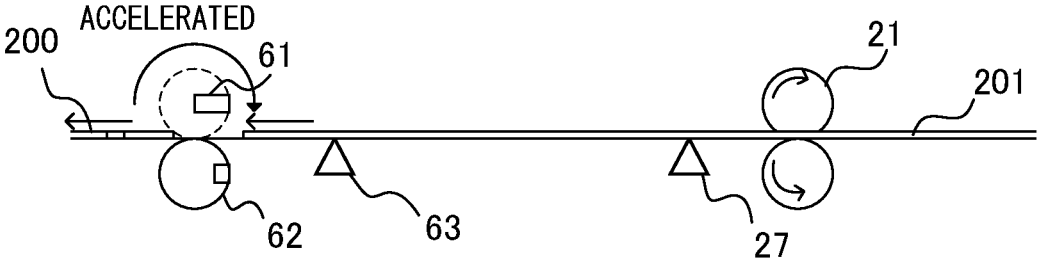
FIG. 11C is a diagram illustrating the sheet, the puncher, and the die in a punching process according to the motor acceleration/deceleration control.
Figure 11D:
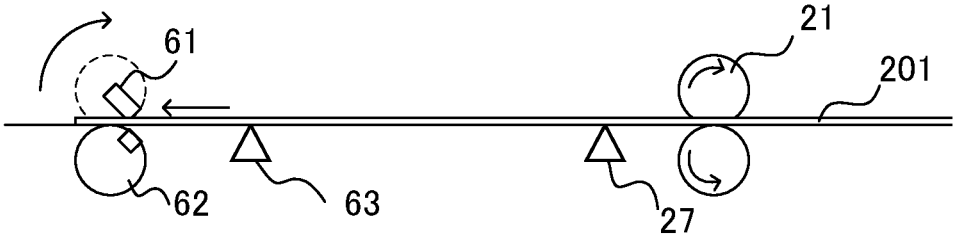
FIG. 11D is a diagram illustrating the sheet, the puncher, and the die in a punching process according to the motor acceleration/deceleration control.
Figure 11E:
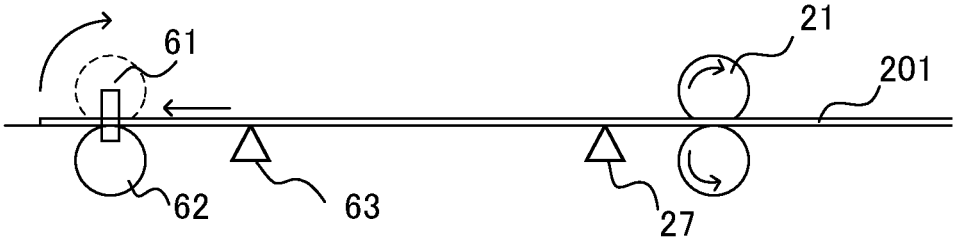
FIG. 11E is a diagram illustrating the sheet, the puncher, and the die in a punching process according to the motor acceleration/deceleration control.

Therefore, as illustrated in FIGS. 11B to 11D, acceleration and deceleration of the puncher driving motor 102 is controlled in accordance with the inter-punching distance between the preceding sheet 200 and the succeeding sheet 201 calculated on the basis of the detection result of the pre-puncher sensor 63. Then, as illustrated in FIG. 11E, a hole is punched in the succeeding sheet 201.

In addition, in the case where it is determined in step S9 of FIG. 6 that the succeeding sheet has not been detected by the pre-puncher sensor 63, that is, in the case where the result of step S9 is No, the succeeding sheet has not come close enough to the puncher 61 yet, and the position of the succeeding sheet cannot be detected with high precision. Therefore, there is a possibility that variation of conveyance of the succeeding sheet will occur. However, since the succeeding sheet has been detected by the entrance sensor 27, there is no temporal room for temporarily stopping the puncher 61 and the die 62 in the home positions.

In such a case, the main controller 101 performs the motor rough/fine adjustment control illustrated as steps S10 to S12 in FIG. 6. In other words, the motor rough/fine adjustment control serving as a control mode and a first control mode is performed in the case where the inter-punching distance is smaller than 150 mm, which is the temporary stop determination threshold value, and the succeeding sheet has not reached the first detection position of the pre-puncher sensor 63. That is, the motor rough/fine adjustment control is performed in the case where the leading end of the succeeding sheet is positioned between the second detection position of the entrance sensor 27 and the first detection position of the pre-puncher sensor 63 when the punching process on the preceding sheet is finished.

The motor rough/fine adjustment control includes motor rough adjustment control of controlling the rotation speed of the puncher 61 on the basis of the detection result of the entrance sensor 27, which corresponds to step S10, and motor fine adjustment control of controlling the rotation speed of the puncher 61 on the basis of the detection result of the pre-puncher sensor 63, which corresponds to step S12. Then, in the motor rough/fine adjustment control, the rotation of the puncher 61 is not stopped in a period between the punching process on the preceding sheet and the punching process on the succeeding sheet.

Motor Rough/Fine Adjustment Control

In the motor rough/fine adjustment control, the motor rough adjustment control as a first process is performed first in step S10, and the main controller 101 monitors the end of the motor rough adjustment control in step S11. In the case where the motor rough adjustment control is finished, that is, in the case where the result of step S11 is Yes, the main controller 101 performs the motor fine adjustment control as a second process in step S12.

In the motor rough adjustment control, the puncher driving motor 102 is controlled by using the detection result of the entrance sensor 27 disposed upstream of the pre-puncher sensor 63 in the sheet conveyance direction. Specifically, acceleration and deceleration of the puncher driving motor 102 is controlled on the basis of the position information of the succeeding sheet detected by the entrance sensor 27. As described above, the position information of the succeeding sheet obtained by the entrance sensor 27 in some distance from the puncher 61 is not so highly precise because there is a room for occurrence of conveyance variation beyond this point. Therefore, the motor fine adjustment control is performed on the basis of information with higher precision after the motor rough adjustment control.

Since the motor fine adjustment control is performed after the motor rough adjustment control, steps to be assigned to the motor fine adjustment control have to be secured among the 250 steps required for one rotation of the puncher 61 without assigning all the 250 steps to the motor rough adjustment control. In the present exemplary embodiment, 170 steps are assigned to the motor rough adjustment control, and the remaining 80 steps are assigned to the motor fine adjustment control. The 170 steps and 80 steps are fixed values. In the motor rough/fine adjustment control, the puncher driving motor 102 is controlled such that the time in which the sheet is conveyed by the inter-punching distance is equal to the time in which the puncher 61 rotates once.

In addition, in the present exemplary embodiment, the rotation speed of the puncher driving motor 102 is returned to 1000 pps, which is the punching speed, when the motor rough adjustment control is finished. This is a process for performing calculation of speed control of the motor rough adjustment control and the motor fine adjustment control relatively easily, and the speed does not have to be returned to the punching speed. Therefore, the rotation speed of the puncher driving motor 102 at the time of switching between the motor rough adjustment control and the motor fine adjustment control may be an arbitrary value.

Figure 12:
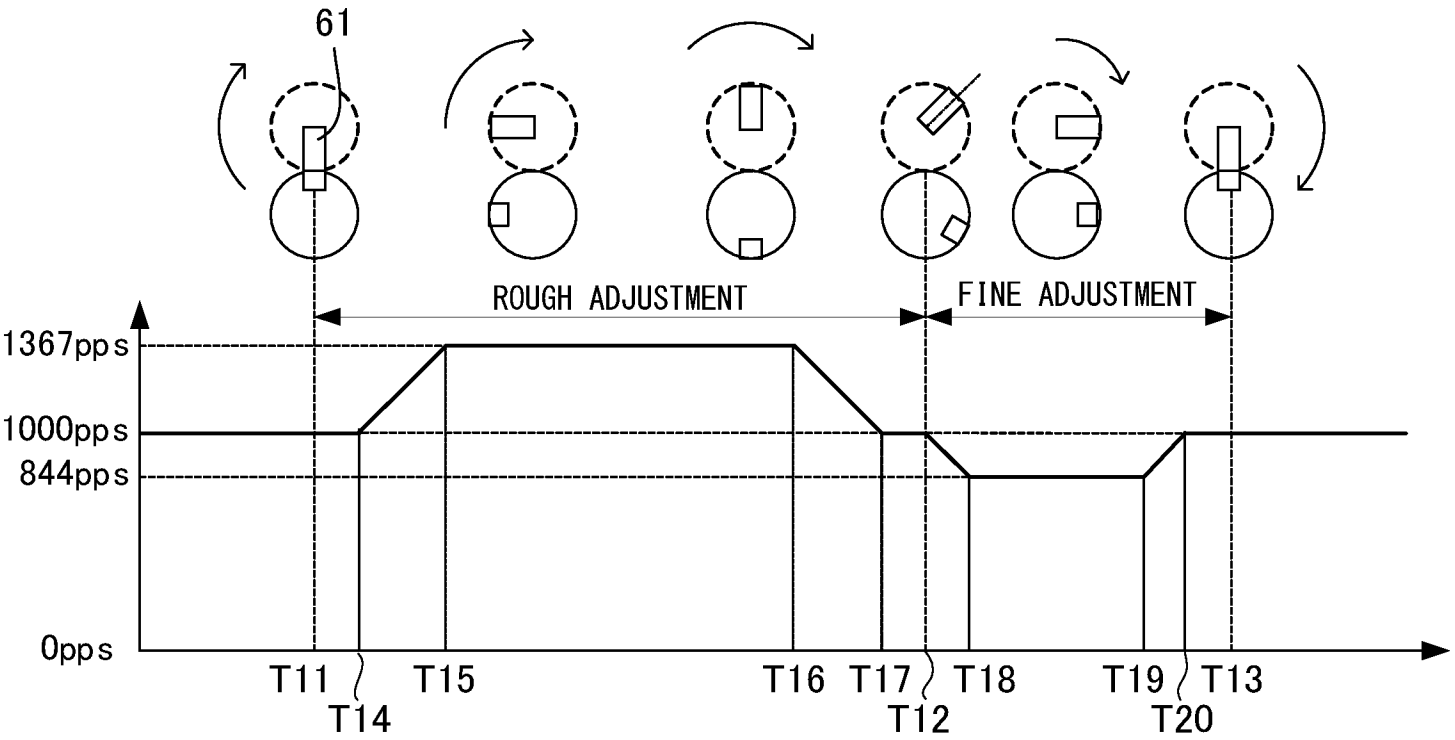
FIG. 12 is a timing chart illustrating rotational positions and rotation speed of the puncher driving motor in the case of performing motor rough/fine adjustment control.

FIG. 12 is a timing chart illustrating rotational positions and rotation speed of the puncher driving motor 102 in the case of performing the motor rough/fine adjustment control. In FIG. 12, the puncher 61 punches a hole in the preceding sheet at a time point T11, and punches a hole in the succeeding sheet at a time point T13. The rotation speed of the puncher driving motor 102 at the time of punching, that is, the punching speed is 1000 pps. In a period from the time point T11 to the time point T13, a period from the time point T11 to a time point T12 corresponds to the motor rough adjustment control, and a period from the time point T12 to the time point T13 corresponds to the motor fine adjustment control.

That is, the motor rough adjustment control is performed after the punching process on the preceding sheet is finished until the leading end of the succeeding sheet reaches the first detection position of the pre-puncher sensor 63. The motor fine adjustment control is performed after the leading end of the succeeding sheet reaches the first detection position of the pre-puncher sensor 63 until the leading end of the succeeding sheet reaches the punching position of the puncher 61 serving as a predetermined position.

In the motor rough/fine adjustment control, the interval between the time point T11 and the time point T13, that is, the punching interval is adjusted by accelerating/decelerating the puncher driving motor 102 without stopping the puncher driving motor 102 in the period from the time point T11 to the time point T13.

Figure 13:
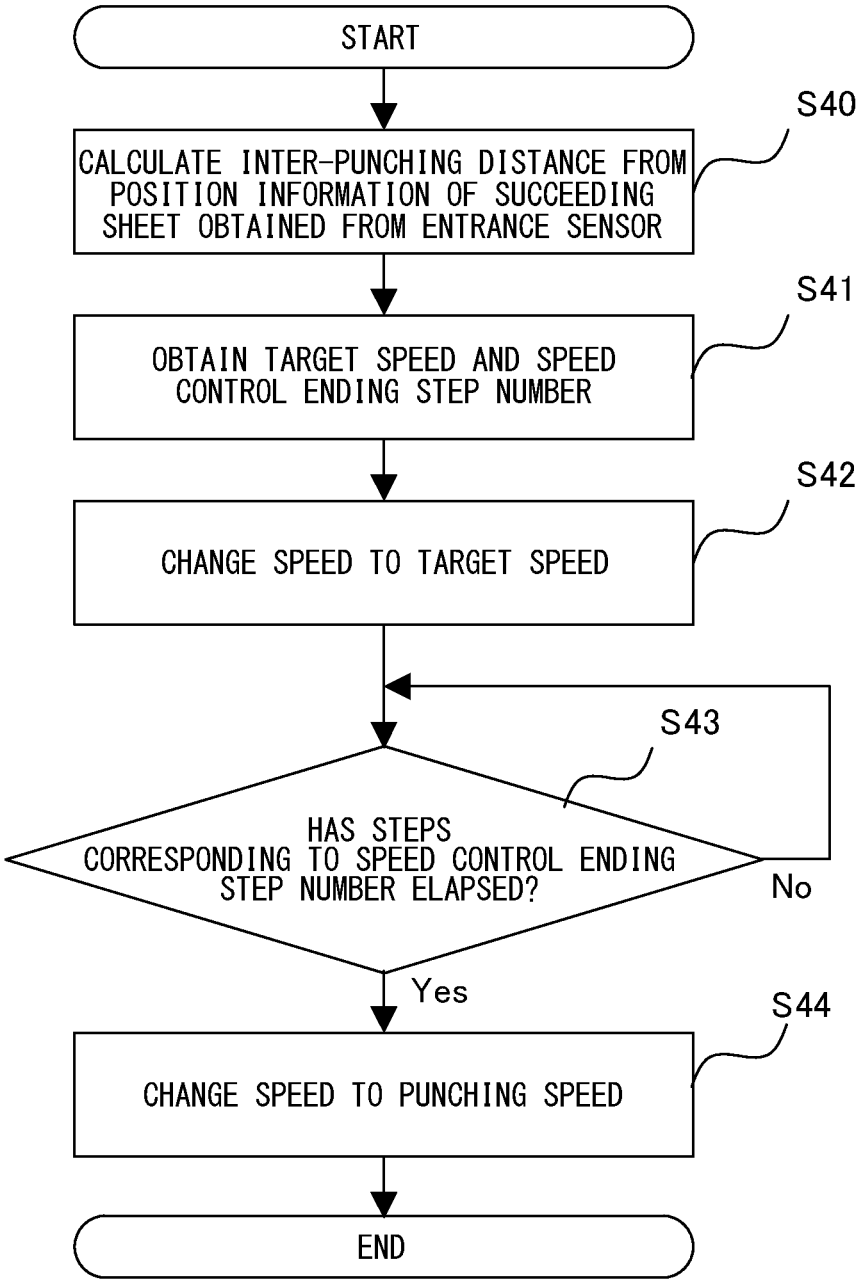
FIG. 13 is a flowchart illustrating each step of motor rough adjustment control.

FIG. 13 is a flowchart illustrating each step of the motor fine adjustment control in detail. As illustrated in FIG. 13, when the motor rough adjustment control is started, the main controller 101 calculates the inter-punching distance in step S40 from the position information of the succeeding sheet detected by the entrance sensor 27. Then, the main controller 101 obtains the target speed and speed control ending step number of the puncher driving motor 102 in step S41 from a control table illustrated in FIG. 14 in accordance with the inter-punching distance calculated in step S40.

FIG. 14 is, similarly to FIG. 9 described above, a control table in which the inter-punching distance [mm] in the motor rough adjustment control, and the target speed [pps] and the speed control ending step number of the puncher driving motor 102 corresponding to the inter-punching distance are described for every 0.1 mm of the inter-punching distance. This control table is stored in the ROM 308. To be noted, whereas the inter-punching distance illustrated in FIG. 9 is calculated from the position information of the succeeding sheet detected by the pre-puncher sensor 63, the inter-punching distance illustrated in FIG. 14 is calculated from the position information of the succeeding sheet detected by the entrance sensor 27. In addition, whereas the speed control ending step number illustrated in FIG. 9 is set on the basis of 250 steps, which is the time required for one rotation of the puncher 61, the speed control ending step number illustrated in FIG. 14 is set on the basis of the 170 steps assigned to the motor rough adjustment control. In the present exemplary embodiment, as illustrated in FIG. 14, an example of a case where the inter-punching distance is calculated as 89.8 mm, the target speed is 1367 pps, and the speed control ending step number is 116 steps is shown.

Then, as illustrated in FIG. 13, the main controller 101 accelerates the puncher driving motor 102 to 1367 pps, which is the target speed, in step S42. Further, the main controller 101 stands by in step S43 until 116 steps, which is the speed control ending step number, elapse after the puncher driving motor 102 has reached the target speed. In the case where steps corresponding to the speed control ending step number have elapsed, that is, in the case where the result of step S43 is Yes, the puncher driving motor 102 is decelerated to 1000 pps, which is the punching speed, in step S44.

As illustrated in FIG. 12, in the motor rough adjustment control described above, the puncher driving motor 102 is driven at 1000 pps in 20 steps from the time point T11 to a time point T14. The objective for this is to match the speed of the puncher 61 with the sheet conveyance speed in the period from the start of punching to the end of the punching on the preceding sheet.

At the time point T14, acceleration of the puncher driving motor 102 to 1367 pps, which is the target speed obtained from the control table, is started. It takes 15 steps to accelerate the puncher driving motor 102 from 1000 pps to 1367 pps, and the speed reaches 1367 pps at a time point T15. This "15 steps" is a step number that can be automatically determined because the gradient of the speed curve is determined in advance.

Then, the puncher driving motor 102 is maintained at 1367 pps, which is the target speed, for 116 steps. At a time point T16 after the elapse of the 116 steps, the puncher driving motor 102 starts being decelerated to 1000 pps, which is the punching speed, and reaches 1000 pps at a time point T17. It takes 15 steps for the puncher driving motor 102 to be decelerated from 1367 pps to 1000 pps. This "15 steps" is also a step number that can be automatically determined because the gradient of the speed curve is determined in advance. Then, the puncher driving motor 102 is driven at 1000 pps in 4 steps from the time point T17 to the time point T12. These 4 steps are a time for preparing for control of the acceleration and deceleration of the puncher driving motor 102 in the motor fine adjustment control that comes again next, to avoid step-out of the puncher driving motor 102 caused by sudden speed change. For example, step-out is likely to occur in the case where the puncher driving motor 102 is decelerated to 1000 pps by the motor rough adjustment control and then suddenly accelerated by the motor fine adjustment control.

The motor rough adjustment control described above is set such that a hole can be punched in a desired position in the succeeding sheet in the case where there is no conveyance variation of the succeeding sheet after the time point T12 and the speed of the puncher driving motor 102 is maintained at 1000 pps, which is the punching speed. In other words, the motor rough adjustment control is set such that, in the case where there is no conveyance variation of the succeeding sheet after the time point T12 and the speed of the puncher driving motor 102 is maintained at 1000 pps, which is the punching speed, the inter-punching distance is 89.8 mm.

Figure 15:
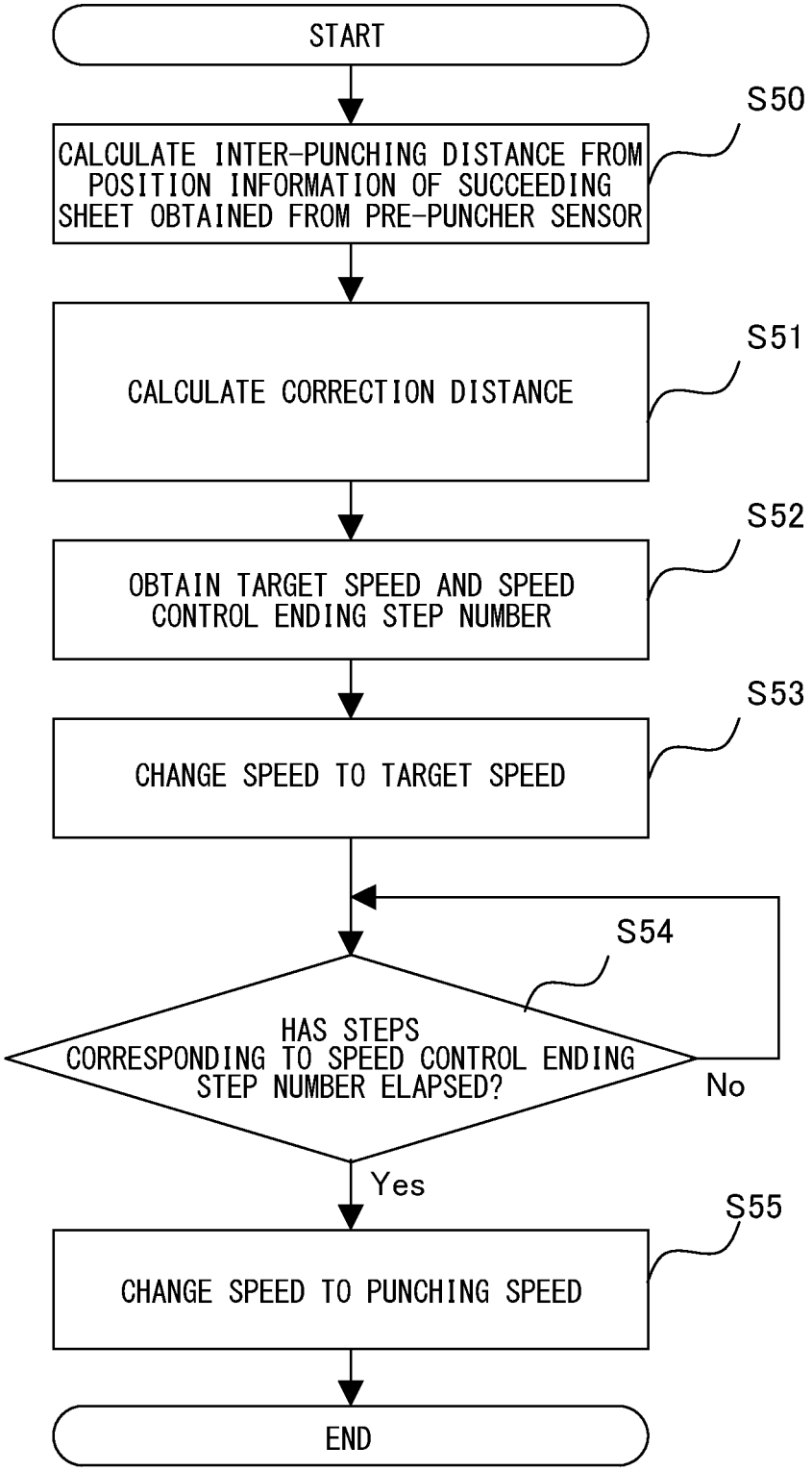
FIG. 15 is a flowchart illustrating each step of motor fine adjustment control.

Next, the motor fine adjustment control will be described in detail. FIG. 15 is a flowchart illustrating each step of the motor fine adjustment control in detail. As illustrated in FIG. 15, when the motor fine adjustment control is started, the main controller 101 calculates, in step S50, the inter-punching distance from the position information of the succeeding sheet detected by the pre-puncher sensor 63. Then, in step S51, the main controller 101 calculates a correction distance from the difference between the inter-punching distance calculated in step S40 and the inter-punching distance calculated in step S50.

In the present exemplary embodiment, an example of a case where the inter-punching distance calculated in step S50 is 85.6 mm is described. This value is 4.2 mm smaller than 89.8 mm, which the inter-punching distance calculated in step S40. That is, the correction distance of the present exemplary embodiment is 4.2 mm. In the motor fine adjustment control, acceleration and deceleration of the puncher driving motor 102 is controlled so as to correct this difference of 4.2 mm. The correction distance being 4.2 mm means that the punching position of the succeeding sheet is displaced from an ideal punching position by 4.2 mm in the case where the speed of the puncher driving motor 102 is maintained at 1000 pps without performing the motor fine adjustment control.

Then, in step S52, the main controller 101 obtains the target speed and speed control ending step number of the puncher driving motor 102 from a control table illustrated in FIG. 16 in accordance with the correction distance calculated in step S51.

FIG. 16 is a control table in which the correction distance [mm] in the motor fine adjustment control, and the target speed [pps] and speed control ending step number of the puncher driving motor 102 corresponding to the correction distance are described for every 0.1 mm of the correction distance. This control table is stored in the ROM 308. To be noted, whereas the speed control ending step number illustrated in FIG. 9 is set on the basis of 250 steps, which is the time required for one rotation of the puncher 61, the speed control ending step number illustrated in FIG. 16 is set on the basis of the 80 steps assigned to the motor fine adjustment control. In the present exemplary embodiment, as illustrated in FIG. 16, an example of a case where the correction distance is calculated as 4.2 mm, the target speed is 844 pps, and the speed control ending step number is 50 steps is shown.

Then, as illustrated in FIG. 15, the main controller 101 accelerates the puncher driving motor 102 to 844 pps, which is the target speed, in step S53. Further, the main controller 101 stands by in step S54 until 50 steps, which is the speed control ending step number, elapse after the puncher driving motor 102 has reached the target speed. In the case where steps corresponding to the speed control ending step number have elapsed, that is, in the case where the result of step S54 is Yes, the puncher driving motor 102 is decelerated to 1000 pps, which is the punching speed, in step S55.

As illustrated in FIG. 12, in the motor fine adjustment control described above, the puncher driving motor 102 starts being decelerated to 844 pps, which is the target speed obtained from the control table, at the time point T12. It takes 5 steps to decelerate the puncher driving motor 102 from 1000 pps to 844 pps, and the speed reaches 844 pps at the time point T18. This "5 steps" is a step number that can be automatically determined because the gradient of the speed curve is determined in advance.

Then, the puncher driving motor 102 is maintained at 844 pps, which is the target speed, for 50 steps. At a time point T19 after the elapse of the 50 steps, the puncher driving motor 102 starts being accelerated to 1000 pps, which is the punching speed, and reaches 1000 pps at a time point T20. It takes 5 steps for the puncher driving motor 102 to be accelerated from 844 pps to 1000 pps. This "5 steps" is also a step number that can be automatically determined because the gradient of the speed curve is determined in advance. Then, the puncher driving motor 102 is driven at 1000 pps in 20 steps from the time point T20 to the time point T13, and a hole is punched in the succeeding sheet at the time point T13. By performing the motor fine adjustment control, the inter-punching distance is corrected, and punching can be performed on sheets at an interval of 89.8 mm.

As described above, the maximum rotation speed of the puncher driving motor 102, that is, the maximum speed of the puncher 61 in the motor fine adjustment control, which is 1000 pps, is different from the maximum rotation speed of the puncher driving motor 102, that is, the maximum speed of the puncher 61 in the motor rough adjustment control, which is 1367 pps. Similarly, the minimum rotation speed of the puncher driving motor 102, that is, the minimum speed of the puncher 61 in the motor fine adjustment control, which is 844 pps, is different from the minimum rotation speed of the puncher driving motor 102, that is, the minimum speed of the puncher 61 in the motor rough adjustment control, which is 1000 pps.

Figure 17A:
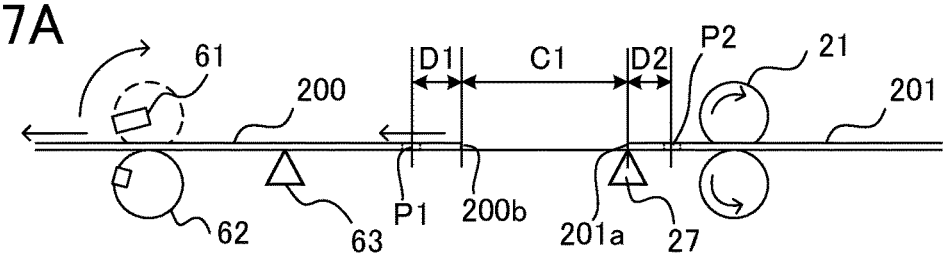
FIG. 17A is a diagram illustrating the sheet, the puncher, and the die in a punching process according to the motor rough/fine adjustment control.

FIGS. 17A to 17G are each a diagram illustrating a state of a sheet, the puncher 61, and the die 62 when performing punching by the motor rough/fine adjustment control. FIG. 17A is a diagram corresponding to a timing at which the leading end 201*a* of the succeeding sheet 201 is detected by the entrance sensor 27, and the sheet interval between the preceding sheet 200 and the succeeding sheet 201 is a distance C1 at this time. In addition, the distance between a last punching position P1 of the preceding sheet 200 and the trailing end 200*b* of the preceding sheet 200 is a distance D1, and the distance between the leading end 201*a* of the succeeding sheet 201 and a first punching position P2 of the succeeding sheet 201 is a distance D2.

Figure 17B:
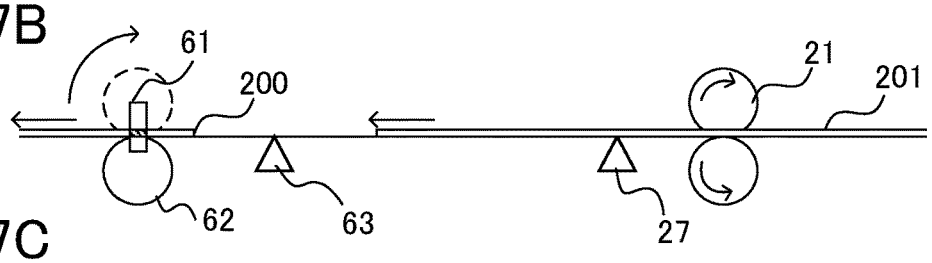
FIG. 17B is a diagram illustrating the sheet, the puncher, and the die in a punching process according to the motor rough/fine adjustment control.

FIG. 17B is a diagram illustrating a state of the sheet, the puncher 61, and the die 62 when the punching on the preceding sheet 200 is finished. At this time, the succeeding sheet 201 has not reached the pre-puncher sensor 63 yet, and therefore the main controller 101 calculates the inter-punching distance on the basis of the detection result of the entrance sensor 27. This inter-punching distance equals to a distance C1+D1+D2. Then, the puncher driving motor 102 is subjected to the motor rough adjustment control on the basis of the target speed and speed control ending step number determined from the control table of FIG. 14 in accordance with this inter-punching distance.

Figure 17C:
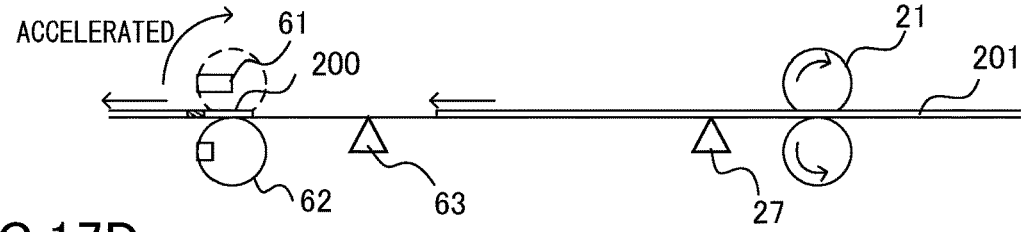
FIG. 17C is a diagram illustrating the sheet, the puncher, and the die in a punching process according to the motor rough/fine adjustment control.
Figure 17D:
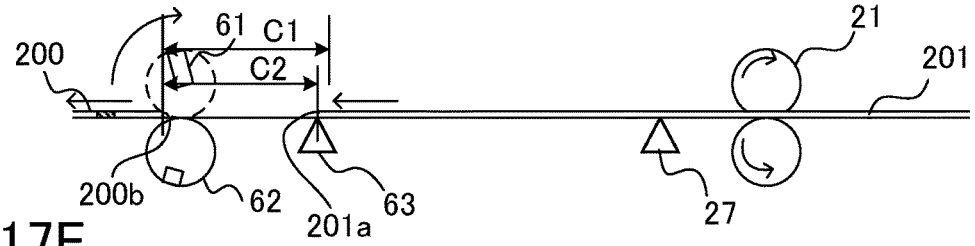
FIG. 17D is a diagram illustrating the sheet, the puncher, and the die in a punching process according to the motor rough/fine adjustment control.

FIG. 17C is a diagram illustrating a state of the sheet, the puncher 61, and the die 62 in the middle of the motor rough adjustment control. Then, as illustrated in FIG. 17D, when the leading end 201*a* of the succeeding sheet 201 is detected by the pre-puncher sensor 63, the main controller 101 calculates the sheet interval between the preceding sheet 200 and the succeeding sheet 201 as a distance C2. This distance C2 is calculated on the basis of the timings at which the trailing end 200*b* of the preceding sheet 200 and the leading end 201*a* of the succeeding sheet 201 are detected by the pre-puncher sensor 63. Then, the main controller 101 calculates the inter-punching distance on the basis of the detection result of the pre-puncher sensor 63. This inter-punching distance equals to a distance C2+D1+D2.

The puncher driving motor 102 is also controlled by the motor rough adjustment control until the 170 steps assigned to the motor rough adjustment control elapse after the leading end 201*a* of the succeeding sheet 201 is detected by the pre-puncher sensor 63.

Figure 17E:
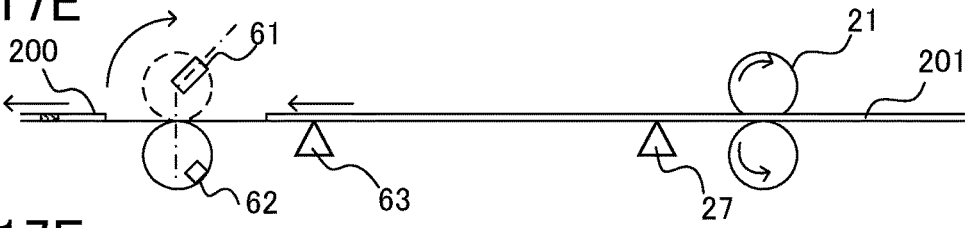
FIG. 17E is a diagram illustrating the sheet, the puncher, and the die in a punching process according to the motor rough/fine adjustment control.

FIG. 17E is a diagram illustrating a state of the sheet, the puncher 61, and the die 62 when the motor rough adjustment control is finished and the motor fine adjustment control is started. In the motor fine adjustment control, a correction distance C1−C2, which is a difference between the inter-punching distance C1+D1+D2 calculated on the basis of the detection result of the entrance sensor 27 and the inter-punching distance C2+D1+D2 calculated on the basis of the detection result of the pre-puncher sensor 63, is calculated. Then, to correct the correction distance C1−C2, acceleration and deceleration of the puncher driving motor 102 is controlled.

Figure 17F:
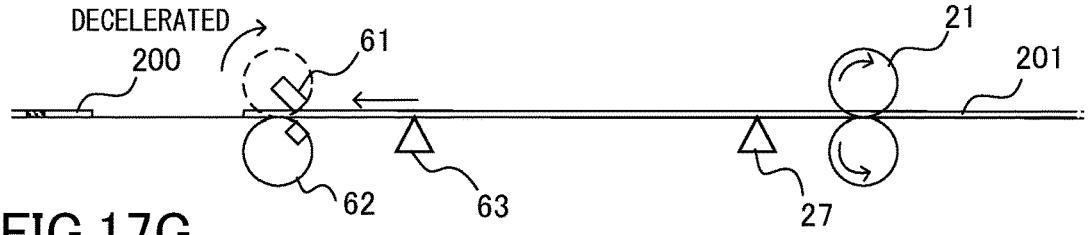
FIG. 17F is a diagram illustrating the sheet, the puncher, and the die in a punching process according to the motor rough/fine adjustment control.
Figure 17G:
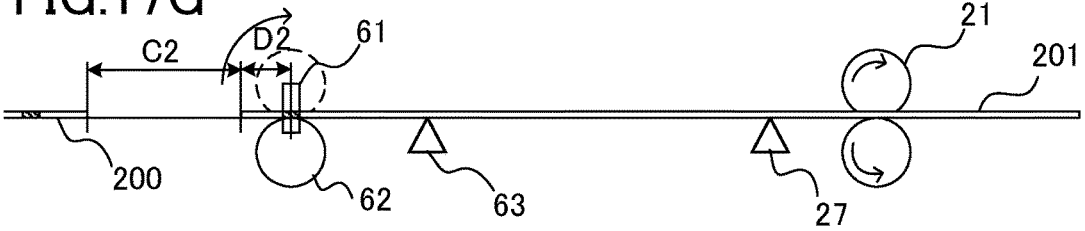
FIG. 17G is a diagram illustrating the sheet, the puncher, and the die in a punching process according to the motor rough/fine adjustment control.

FIG. 17F is a diagram illustrating a state of the sheet, the puncher 61, and the die 62 in the middle of the motor fine adjustment control. Then, as illustrated in FIG. 17G a hole is punched in a desired position in the succeeding sheet 201. As described above, punching on a sheet can be performed with high precision even in the case where the sheet interval or the inter-punching distance between the preceding sheet 200 and the succeeding sheet 201 is changed when the leading end 201*a* of the succeeding sheet 201 is at a position between the detection position of the entrance sensor 27 and the detection position of the pre-puncher sensor 63.

As described above, in the present exemplary embodiment, one of the temporary stop control, the motor acceleration/deceleration control, and the motor rough/fine adjustment control is performed in accordance with the inter-punching distance calculated when the punching on the preceding sheet 200 is finished. Specifically, in the case where the inter-punching distance is equal to or larger than the temporary stop determination threshold value, which is 150 mm in this example, the temporary stop control is performed. In particular, the temporary stop control is performed in the case where the leading end 201*a* of the succeeding sheet 201 is positioned upstream of the detection position of the entrance sensor 27 in the sheet conveyance direction when the punching on the preceding sheet 200 is finished.

In addition, in the case where the inter-punching distance is smaller than the temporary stop determination threshold value, the puncher driving motor 102 is controlled in a manner that differs depending on where the leading end 201*a* of the succeeding sheet 201 is positioned. Specifically, the motor acceleration/deceleration control is performed in the case where the leading end 201*a* of the succeeding sheet 201 is positioned downstream of the pre-puncher sensor 63 in the sheet conveyance direction when the punching on the preceding sheet 200 is finished. The motor rough/fine adjustment control is performed in the case where the leading end 201*a* of the succeeding sheet 201 is positioned between the detection position of the entrance sensor 27 and the detection position of the pre-puncher sensor 63 when the punching on the preceding sheet 200 is finished.

Particularly, in the motor acceleration/deceleration control and the motor rough/fine adjustment control, since the puncher driving motor 102 is not temporarily stopped, the sheet interval can be further reduced, and thus the productivity can be improved. Further, in the motor rough/fine adjustment control, since the acceleration and deceleration of the puncher driving motor 102 is controlled in two steps by the motor rough adjustment control and the motor fine adjustment control, the magnitude of the acceleration and deceleration can be reduced, which reduces noises from the motor and also contributes to energy saving. In addition, since the motor fine adjustment control is performed on the basis of the detection result of the pre-puncher sensor 63, which is closer to the puncher 61, the precision of the punching can be improved.

Second Exemplary Embodiment

Next, a second exemplary embodiment of a second exemplary embodiment of the present invention will be described. The second exemplary embodiment is different from the first exemplary embodiment in that a different temporary stop determination threshold value is set in accordance with the sheet conveyance speed. Therefore, the same elements as in the first exemplary embodiment are denoted by the same reference signs or illustration thereof will be omitted.

Functional Configuration

Figure 18:
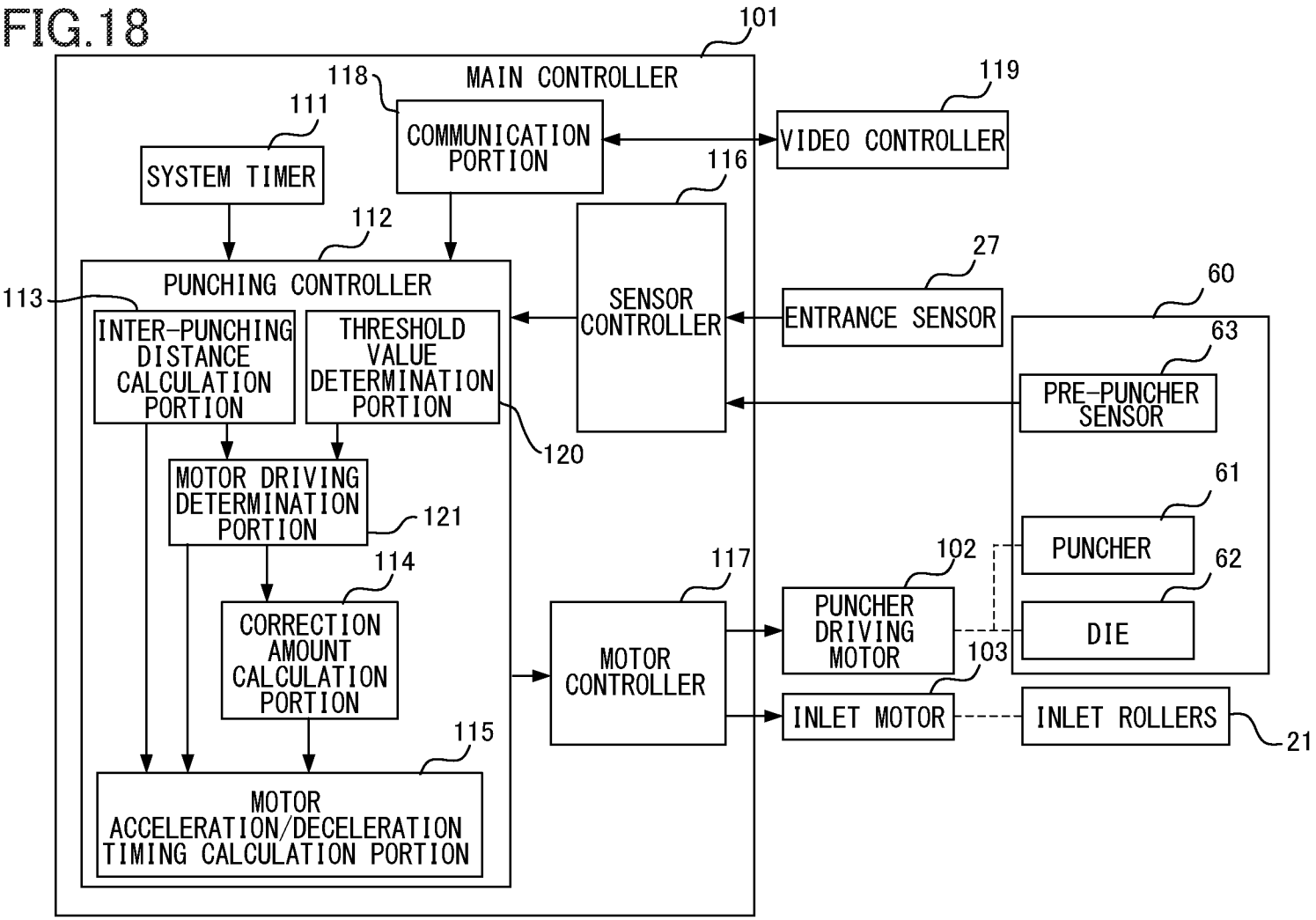
FIG. 18 is a block diagram illustrating a functional configuration of an image forming system according to a second exemplary embodiment.

FIG. 18 is a block diagram illustrating a functional configuration of the image forming system 1S. To be noted, in FIG. 18, mainly portions related to control of punching on a sheet according to the present exemplary embodiment are illustrated, and other portions are omitted.

In FIG. 18, the video controller 119, a communication portion 118, and a threshold value determination portion 120 are added to the block diagram of FIG. 4. The main controller 101 includes the communication portion 118 that communicates with the video controller 119, and the punching control is performed mainly on the basis of information that the punching controller 112 has obtained through communication. In addition, the punching controller 112 includes the threshold value determination portion 120 that calculates the temporary stop determination threshold value used for determining whether or not to perform the temporary stop control. In the present exemplary embodiment, information of the conveyance speed of the conveyed sheet is obtained from the video controller 119 through communication, and a parameter used for the punching control is switched in accordance with the conveyance speed.

Punching Control

Figure 19:
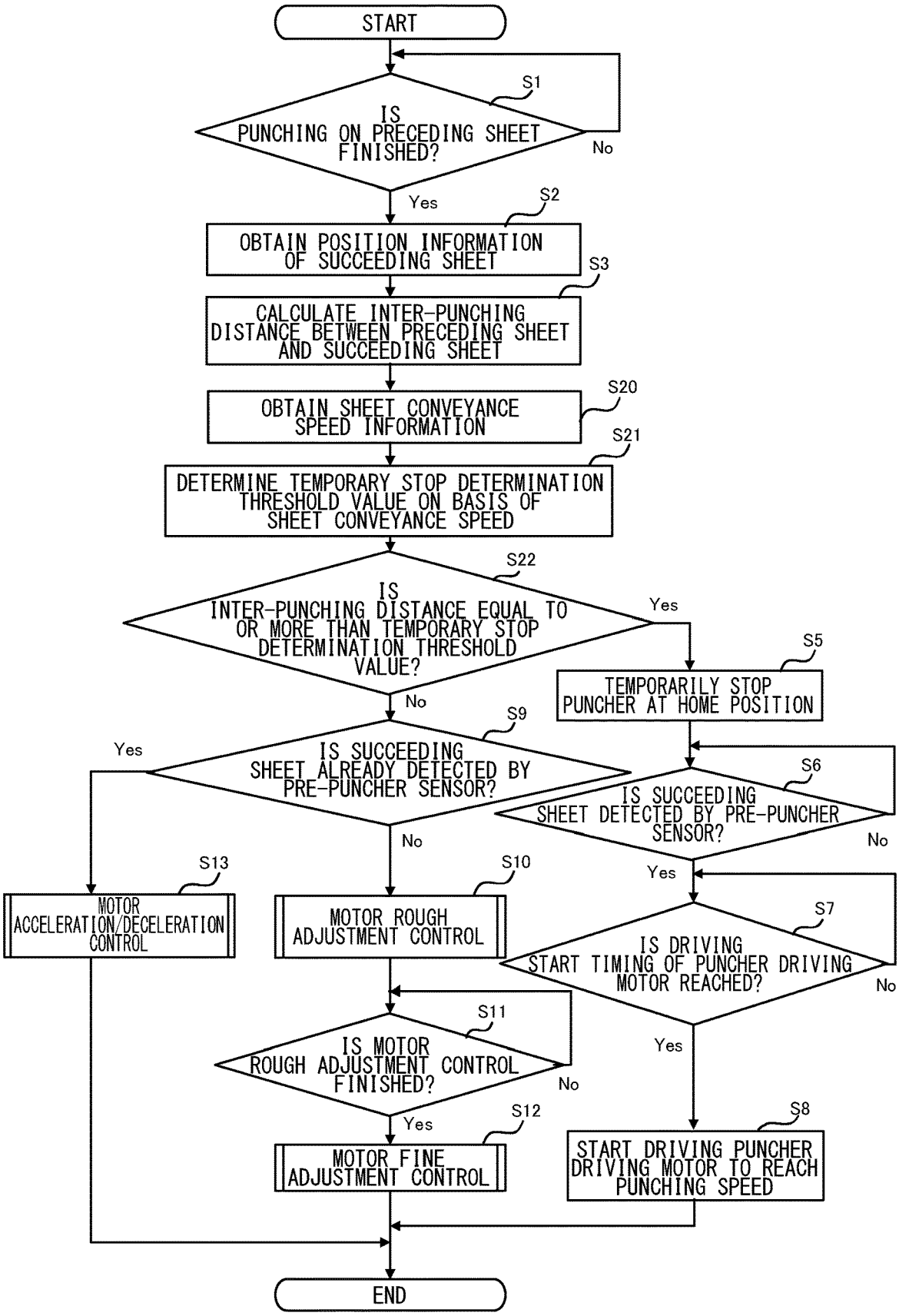
FIG. 19 is a flowchart illustrating punching control according to the second exemplary embodiment.

FIG. 19 is a flowchart illustrating the punching control of the second exemplary embodiment, and description of parts similar to the flowchart illustrated in FIG. 6 will be omitted. After calculating the inter-punching distance in step S3, the main controller 101 obtains sheet conveyance speed information from the video controller 119 in step S20 as illustrated in FIG. 19.

Then, the main controller 101 determines the temporary stop determination threshold value in step S21 on the basis of the sheet conveyance speed. Here, tables shown in FIGS. 20A and 20B will be described. FIG. 20A is a table showing minimum inter-punching distances with which the temporary stop control of the puncher driving motor 102 can be performed. In the first exemplary embodiment, a case where the sheet conveyance speed corresponding to the punching speed of the puncher 61 is 420 mm/sec has been described. Further, as illustrated in FIG. 20A, in the case where the sheet conveyance speed corresponding to the punching speed of the puncher 61 is 420 mm/sec, the minimum inter-punching distance is 117.9 mm, and therefore the temporary stop determination threshold value is set to a fixed value of 150 mm in the first exemplary embodiment.

However, in the case where the sheet conveyance speed corresponding to the punching speed of the puncher 61 is 246 mm/sec, the minimum inter-punching distance is 75.6 mm. The reason why the minimum inter-punching distance changes in accordance with the sheet conveyance speed as described above is because the specifications of the puncher driving motor 102 are not dependent on the sheet conveyance speed. Specifically, the holding time of temporary stop, the upper limit and lower limit of the rotation speed, and the gradient of the speed curve of acceleration/deceleration of the puncher driving motor 102 do not change in accordance with the sheet conveyance speed. Therefore, in the case where the sheet conveyance speed is low, the inter-punching distance with which temporary stop can be performed is short.

In contrast, in the case where the rotation of the puncher driving motor 102 is continued without being temporarily stopped, the range of the inter-punching distance that can be supported is narrower when the sheet conveyance speed is lower. FIG. 20B is a table showing ranges of the inter-punching distance to which the motor rough adjustment control is applicable and ranges of the correction distance to which the motor fine adjustment control is applicable. Particularly, FIG. 20B shows the ranges of the inter-punching distance and correction distance for each combination of rough adjustment step number and fine adjustment step number for each of the case where the sheet conveyance speed corresponding to the punching speed of the puncher 61 is 420 mm/sec and the case where the sheet conveyance speed is 246 mm/sec. The rough adjustment step number is the number of steps assigned to the motor rough adjustment control, and the fine adjustment step number is the number of steps assigned to the motor fine adjustment control.

Further, as can be seen from the table of FIG. 20B, in the case where the sheet conveyance speed is 246 mm/sec, the upper limit of the inter-punching distance to which the motor rough adjustment control is applicable is about 120 mm. That is, it can be seen that it is not appropriate to apply the temporary stop determination threshold value of 150 mm set in the first exemplary embodiment to the case where the sheet conveyance speed is 246 mm/sec. For example, in the case where the calculated inter-punching distance is about 140 mm, even if continuation of the driving of the puncher driving motor 102 is determined at the time of punching on the preceding sheet, the problem cannot be solved by the motor rough adjustment control including steps S3, S4, S9, and S10 of FIG. 6.

Therefore, in the present exemplary embodiment, the temporary stop determination threshold value is set in accordance with the sheet conveyance speed. For example, in the case where the sheet conveyance speed is 246 mm/sec, the temporary stop determination threshold value is set to 80 mm. For example, a table describing the relationship between the sheet conveyance speed and the temporary stop determination threshold value is stored in the ROM 308 in advance.

In this manner, a margin for the conveyance variation can be secured because the minimum inter-punching distance with which the temporary stop control of the puncher driving motor 102 can be performed is 75.6 mm in the case where the sheet conveyance speed is 246 mm/sec as illustrated in FIG. 20A. In addition, among the inter-punching distances to which the motor rough adjustment control and the motor fine adjustment control are applicable, the motor rough adjustment control and the motor fine adjustment control can be applied to inter-punching distances equal to or smaller than the temporary stop determination threshold value described above. In the present exemplary embodiment, since the temporary stop determination threshold value is determined on the basis of the sheet conveyance speed, punching processes corresponding to various sheet conveyance speeds can be performed.

Third Exemplary Embodiment

Next, a third exemplary embodiment of the present invention will be described. The third exemplary embodiment is different from the first exemplary embodiment in that the numbers of steps assigned to the motor rough adjustment control and the motor fine adjustment control are changed in accordance with the type of the sheet. The type of the sheet may be obtained from the video controller 119 through the communication portion 118, a cassette of the feeding apparatus 6 of the image forming system 1S, or a media sensor provided in a conveyance path.

As illustrated in FIG. 20B, by changing the rough adjustment step number and the fine adjustment step number, the ranges of the inter-punching distance to which the motor rough adjustment control is applicable and the correction distance to which the motor fine adjustment control is applicable change. In addition, a different tendency can be seen in the conveyance variation for a different type of sheet that is conveyed. For example, different tendencies can be seen for regular paper sheets, thin paper sheets, cardboards, and gloss paper sheets. Therefore, there is no need to perform the same motor rough adjustment control and motor fine adjustment control on all kinds of sheets.

For example, in the case where information that the conveyance variation is large for cardboards is known in advance, the number of steps assigned to the motor fine adjustment control may be increased when conveying a cardboard. The table describing the relationship between the type of sheet and the assignment of steps is stored in, for example, the ROM 308 in advance.

As described above, in the present exemplary embodiment, the assignment of steps to the motor rough adjustment control and the motor fine adjustment control is changed on the basis of the type of the sheet, and thus punching processes suitable for sheets of various types can be performed.

In addition, although a case of the image forming apparatus 1 of an electrophotographic system has been described in all of the exemplary embodiments described above, the present invention is not limited to this. For example, the present invention can be also applied to an image forming apparatus of an inkjet system that forms an image on a sheet by ejecting an ink liquid from a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-130601, filed Jul. 12, 2019, which is hereby incorporated by reference herein in its entirety.

What is claimed is:

1. A sheet processing apparatus comprising:

a conveyance portion configured to convey a sheet in a conveyance direction;

a puncher rotatably supported and configured to, while rotating, punch a hole at a predetermined position in a sheet being conveyed by the conveyance portion;

a first sensor configured to change an output value thereof in accordance with presence/absence of a sheet at a first detection position positioned upstream of the puncher in the conveyance direction;

a drive source configured to drive the puncher; and a controller configured to control the drive source so as to control a rotation speed of the puncher on a basis of a detection result of the first sensor, wherein the controller is configured to execute a process in which the controller does not stop rotation of the puncher in a period between a punching process on a preceding sheet and a punching process on a succeeding sheet.

2. The sheet processing apparatus according to claim 1, further comprising a second sensor configured to change an output value thereof in accordance with presence/absence of a sheet at a second detection position positioned upstream of the first detection position in the conveyance direction.

3. The sheet processing apparatus according to claim 2, wherein, in a case where a leading end of the succeeding sheet is positioned between the first detection position and the second detection position in the conveyance direction when the punching process on the preceding sheet by the puncher is finished, the controller executes a control mode including a first process of controlling a rotation speed of the puncher on a basis of a detection result of the second sensor and a second process of controlling the rotation speed of the puncher on a basis of a detection result of the first sensor.

4. The sheet processing apparatus according to claim 3, wherein a maximum rotation speed of the puncher in the second process is different from a maximum rotation speed of the puncher in the first process.

5. The sheet processing apparatus according to claim 3, wherein, in the control mode, the controller controls the drive source such that a time in which a sheet is conveyed by an inter-punching distance is equal to a time in which the puncher rotates once, the inter-punching distance being a distance between a last punching position on the preceding sheet and a first punching position on the succeeding sheet in the conveyance direction.

6. The sheet processing apparatus according to claim 5, wherein, in the second process, the controller controls the drive source so as to correct a difference between the inter-punching distance calculated on a basis of a detection result of the second sensor and the inter-punching distance calculated on a basis of a detection result of the first sensor.

7. The sheet processing apparatus according to claim 5, wherein the control mode is a first control mode, wherein in a case where the inter-punching distance obtained when the punching process on the preceding sheet by the puncher is finished is equal to or larger than a predetermined threshold value, the controller executes a second control mode of temporarily stopping rotation of the puncher, wherein in a case where the inter-punching distance obtained when the punching process on the preceding sheet by the puncher is finished is smaller than the predetermined threshold value and the succeeding sheet has reached the first detection position, the controller executes a third control mode of controlling the rotation speed of the puncher on the basis of the detection result of the first sensor, and wherein in a case where the inter-punching distance obtained when the punching process on the preceding sheet by the puncher is finished is smaller than the predetermined threshold value and the succeeding sheet has not reached the first detection position, the controller executes the first control mode.

8. The sheet processing apparatus according to claim 7, wherein the threshold value is a fixed value.

9. The sheet processing apparatus according to claim 7, wherein the threshold value is set in accordance with a sheet conveyance speed of the conveyance portion.

10. The sheet processing apparatus according to claim 3, wherein the rotation speed of the puncher when the first process is finished is equal to the rotation speed of the puncher when punching a hole in a sheet.

11. The sheet processing apparatus according to claim 3, wherein the drive source is a stepping motor, and wherein, among steps of the drive source required for one rotation of the puncher, a number of steps assigned to the first process and a number of steps assigned to the second process are each a fixed value.

12. The sheet processing apparatus according to claim 3, wherein the drive source is a stepping motor, and wherein, among steps of the drive source required for one rotation of the puncher, a number of steps assigned to the first process and a number of steps assigned to the second process are changed in accordance with a type of a conveyed sheet.

13. The sheet processing apparatus according to claim 2, further comprising:

a first conveyance path configured to receive a sheet;

a reverse portion configured to reverse a sheet received from the first conveyance path;

a supporting portion configured to support thereon a sheet reversed by the reverse portion;

a second conveyance path extending below the first conveyance path and configured to receive a sheet reversed by the reverse portion and guide the sheet received thereby to the supporting portion;

a discharge portion configured to discharge a sheet to an outside of the sheet processing apparatus;

a third conveyance path extending from the supporting portion toward the discharge portion and configured to guide a sheet to the discharge portion; and a rotary member pair disposed in the second conveyance path and configured to discharge a sheet onto the supporting portion.

14. The sheet processing apparatus according to claim 13, wherein the puncher, the first sensor, and the second sensor are disposed in the first conveyance path.

15. An image forming system comprising:

an image forming apparatus configured to form an image on a sheet; and the sheet processing apparatus according to claim 1 configured to receive a sheet from the image forming apparatus.

16. A sheet processing apparatus comprising:

a conveyance portion configured to convey a sheet in a conveyance direction;

a puncher rotatably supported and configured to, while rotating, punch a hole at a predetermined position in a sheet being conveyed by the conveyance portion;

a first sensor configured to change an output value thereof in accordance with presence/absence of a sheet at a first detection position positioned upstream of the puncher in the conveyance direction;

a second sensor configured to change an output value thereof in accordance with presence/absence of a sheet at a second detection position positioned upstream of the first detection position in the conveyance direction;

a drive source configured to drive the puncher; and a controller configured to control the drive source, wherein the controller is configured to temporarily stopping rotation of the puncher in a case where a distance between a preceding sheet punched by the puncher and a succeeding sheet is equal to and larger than a predetermined distance on a basis of a detection result of the second sensor, thereafter configured to drive the puncher on a basis of a detection result of the first sensor.

17. The sheet processing apparatus according to claim 16, wherein, in a case where a leading end of a succeeding sheet is positioned between the first detection position and the second detection position in the conveyance direction when a punching process on a preceding sheet by the puncher is finished, the controller executes a control mode including a first process of controlling a rotation speed of the puncher on a basis of a detection result of the second sensor and a second process of controlling the rotation speed of the puncher on a basis of a detection result of the first sensor.

18. The sheet processing apparatus according to claim 17, wherein the drive source is a stepping motor.

19. The sheet processing apparatus according to claim 17, further comprising:

a first conveyance path configured to receive a sheet;

a reverse portion configured to reverse a sheet received from the first conveyance path;

a supporting portion configured to support thereon a sheet reversed by the reverse portion;

a second conveyance path extending below the first conveyance path and configured to receive a sheet reversed by the reverse portion and guide the sheet received thereby to the supporting portion;

a discharge portion configured to discharge a sheet to an outside of the sheet processing apparatus;

a third conveyance path extending from the supporting portion toward the discharge portion and configured to guide a sheet to the discharge portion; and a rotary member pair disposed in the second conveyance path and configured to discharge a sheet onto the supporting portion.

20. The sheet processing apparatus according to claim 19, wherein the puncher, the first sensor, and the second sensor are disposed in the first conveyance path.

* * * * *